United States Patent [19]

Matsuura et al.

[11] 3,962,144

[45] June 8, 1976

[54] PROCESS FOR MAKING A VOLTAGE DEPENDENT RESISTOR

[75] Inventors: Mikio Matsuura, Hirakata; Michio Matsuoka, Ibaragi; Osamu Makino, Hirakata, all of Japan

[73] Assignee: Matsushita Electric Industrial Co., Ltd., Japan

[22] Filed: Oct. 16, 1974

[21] Appl. No.: 515,360

[30] Foreign Application Priority Data

Oct. 19, 1973 Japan ..... 48-118219

[52] U.S. Cl. ..... 252/517; 252/518; 252/519; 252/520; 252/521

[51] Int. Cl.[2] ..... H01B 1/08

[58] Field of Search ..... 252/518, 519, 520, 521, 252/517

[56] References Cited

UNITED STATES PATENTS

| | | | |
|---|---|---|---|
| 3,663,458 | 5/1972 | Masuyama et al. | 252/520 X |
| 3,764,566 | 10/1973 | Matsuoka et al. | 252/518 |
| 3,903,226 | 9/1975 | Iga et al. | 252/518 X |

*Primary Examiner*—Benjamin R. Padgett
*Assistant Examiner*—E. Suzanne Parr
*Attorney, Agent, or Firm*—Wenderoth, Lind & Ponack

[57] ABSTRACT

A process for making a bulk-type voltage-dependent resistor and more particularly to a varistor comprising a zinc oxide sintered body using heat-treated zinc oxide powder. By heat-treating zinc oxide powder before the sintering step, a bulk-type voltage-dependent resistor is obtainable which is characterized by a high n-value in a region of current higher than $10A/cm^2$ and high power dissipation as well as a lower C-value.

16 Claims, 1 Drawing Figure

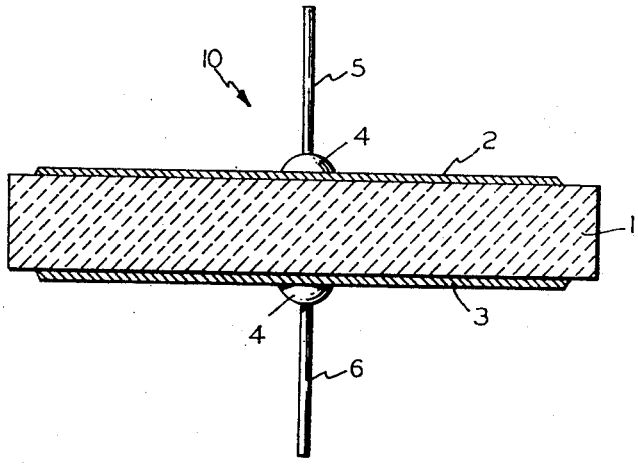
10
5
4
2
1
3
4
6

PROCESS FOR MAKING A VOLTAGE DEPENDENT RESISTOR

This invention relates to a process for making voltage dependent resistors (varistors) having non-ohmic resistance (voltage-dependent property) due to the bulk thereof and more particularly to voltage-dependent resistors, which are suited e.g. for surge absorbers using heat-treated zinc oxide, and additives.

Various voltage-dependent resistors such as silicon carbide voltage-dependent resistors, selenium rectifiers and germanium or silicon p-n junction diodes have been widely used for stabilization of voltage of electrical circuits or suppression of abnormally high surge induced in electrical circuits. The electrical characteristics of such voltage-dependent resistors are expressed by the relation:

$$I = \left( \frac{V}{C} \right)^n \qquad (1)$$

where V is the voltage across the resistor, I is the current flowing through the resistor, C is a constant corresponding to the voltage at a given current and exponent n is a numerical value greater than 1. The value of n is calculated by the following equation:

$$n = \frac{\log_{10}(I_2/I_1)}{\log_{10}(V_2/V_1)} \qquad (2)$$

where $V_1$ and $V_2$ are the voltage at given currents $I_1$ and $I_2$, respectively. The desired value of C depends upon the kind of application to which the resistor is to be put. It is ordinarily desirable that the value of n be as large as possible since this exponent determines the extent to which the resistors depart from ohmic characteristics. Conveniently the, n-value defined by $I_1$, $I_2$, $V_1$ and $V_2$ as shown in equation (2) is expressed by ${}_1n_2$ for distinguishing from the n-value calculated by other currents or voltages.

Voltage-dependent resistors comprising sintered bodies of zinc oxide with or without additives and non-ohmic electrodes applied thereto, have already been disclosed as seen in U.S. Pat. Nos. 3,496,512, 3,570,002, 3,503,029, 3,689,863 and 3,766,098. The nonlinearity (voltage-dependent property) of such voltage-dependent resistors is attributed to the interface between the sintered body of zinc oxide with or without additives and a silver paint electrode, and is controlled mainly by changing the compositions of the sintered body and the silver paint electrode. Therefore, it is not easy to control the C-value over a wide range after the sintered body is prepared. Similarly, in voltage-dependent resistors comprising germanium or silicon p-n junction diodes, it is difficult to control the c-value over a wide range because the nonlinearity of these voltage-dependent resistors is not attributed to the bulk but rather to the p-n junction. In addition, it is almost impossible for those zinc oxide voltage-dependent resistors mentioned above and germanium or silicon diode voltage-dependent resistors to have a combination of a C-value higher than 100 volt, an n-value higher than 10 and high surge resistance tolerable for a surge of more than 100A.

On the other hand, the silicon carbide voltage-dependent resistors have nonlinearity due to the contacts among the individual grains of silicon carbide bonded together by a ceramic binding material, i.e. to the bulk, and the C-value is controlled by changing a dimension in the direction in which the current flows through the voltage-dependent resistors. In addition, the silicon carbide voltage-dependent resistors have high surge resistance thus rendering them suitable e.g. as surge absorbers and as characteristic elements of lightning arresters. The characteristic elements are used usually by connecting them in series with discharging gaps and determine the level of the discharging voltage and the follow current. However, the silicon curbide varistors, have a relatively low n-value ranging from 3 to 7 which results in poor suppression of lightning surge or increase in the follow current. Another defect of the arrester with a discharging gap is slow response to surge voltage a very short rise time such as below 1$\mu$s. It is desirable for the arrester to surpress the lightning surge and the follow current to a level as low as possible and respond to surge voltage instantaneously. The silicon carbide voltage-dependent resistors, however, have a relatively low n-value ranging from 3 to 7 which results in poor surge suppression.

There have been known, on the other hand, voltage-dependent resistors of the bulk type comprising a sintered body of zinc oxide with additives, as seen in U.S. Pat. Nos. 3,633,458, 3,632,529, 3,634,337, 3,598,763, 3,682,841, 3,642,664, 3,658,725, 3,687,871, 3,723,175, 3,778,743, 3,806,765 3,811,103 and copending U.S. Pat. application Nos. 29,416, 388,169, now U.S. Pat. No. 3,863,193, 428,737, now U.S. Pat. No. 3,872,582 and 489,827. These zinc oxide voltage-dependent resistors of the bulk type contain, as additives, one or more combinations of oxides or fluorides of bismuth, cobalt, manganese, barium, boron, berylium, magnesium, calcium, strontium, titanium, antimony, germanium, chromium and nickel, and the C-value is by changing, mainly, the compositions of said sintered body and the distance between electrodes and they have an excellent voltage-dependent properties for in an n-value in a region of current less than 10A/cm$^2$. For a current higher than 10A/cm$^2$, however, the n-value goes down to a value lower than 10. This defect of these zinc oxide voltage-dependent resistors of bulk type is presumably mainly due to their low n-value for the lower C-value, especially less than 70 volts. In general, these zinc oxide voltage-dependent resistors of the bulk type, mentioned above, have a very low n-value i.e. less than 20, when the C-value is lower than 70 volts. The development of the voltage-dependent resistors having a C-value less than 70 volts has been required for the application to low voltage circuits, such as in the automobile industry and home appliances, but the n-value of a conventional voltage-dependent resistor having such a lower C-value is too small for uses such as voltage stabilizers and surge absorbers. For these reasons, voltage-dependent resistors of this type having a C-value less than 70 volts have been used infrequently in the low voltage applications.

An object of the present invention is to provide a method for making a bulk-type voltage dependent resistor characterized by a high n-value in a region of current higher than 10A/cm$^2$ and a high power dissipation for surge impulse.

Another object of the present invention is to provide a method for making a bulk-type voltage-dependent resistor having a lower C-value.

These and other objects of this invention will become apparent upon consideration of the following detailed description taken together with the accompanying drawing in which the single FIGURE is a cross-sectional view of a voltage dependent resistor in accordance with this invention.

Before proceeding with a detailed description of the manufacturing process of the voltage-dependent resistor contemplated by this invention, its construction will be described with reference to the single FIGURE wherein reference numeral 10 designates, as a whole, a voltage-dependent resistor comprising, as its active element, a sintered body having a pair of electrodes 2 and 3 in an ohmic contact with to opposite surfaces thereof. The sintered body 1 is prepared in a manner hereinafter set forth and is any form such as circular, square or rectangular plate form. Wire leads 5 and 6 are attached conductively to the electrodes 2 and 3, respectively, by a connection means 4 such as solder or the like. According to this invention, a process for making a bulk-type voltage-dependent resistor comprising a sintered body consisting essentially of, as a major part, zinc oxide (ZnO), and additives, and having electrodes to the opposite surfaces of said sintered body, characterized by a high n-value in a region of current higher than 10A/cm$^2$, a high power dissipation for a surge pulse and a low C-value, especially less than 70 volts, comprises heat-treating of the zinc oxide powder used for the sintered body at a temperature between 500°C and 1000°C.

It has been discovered according to the invention that the n-value both in a region of current more than 10A/cm$^2$ and in a region of current between 0.1mA and 1mA, the power dissipation for a surge pulse and a low C-value, especially, less than 70 volts, are further improved when said heat-treating temperature of the zinc oxide powder is between 700°C and 800°C. A composition for use as said zinc oxide sintered body having voltage dependent properties by itself, according to the present invention, can be prepared by using those of described in U.S. Pat. Nos. 3,633,458, 3,632,529, 3,634,337, 3,598,763, 3,682,841, 3,642,664, 3,648,725, 3,687,871, 3,723,175, 3,778,743, 3,806,765, 3,811,103 and copending U.S. Pat. applications Nos. 29,416, 388,169, now U.S. Pat. No. 3,863,193, 428,737, now U.S. Pat. No. 3,872,582 and 489,827. Among various compositions, a more desirable result can be obtained with a composition consisting essentially of, as a main constituent, 99.98 to 80 mole percent of zinc oxide (ZnO), and, as additives, 0.01 to 10 mole percent of bismuth oxide ($Bi_2O_3$), and 0.01 to 10 mole percent, in total, of two members selected from the group consisting of cobalt oxide (CoO), uranium oxide ($UO_2$), manganese oxide (MnO), antimony oxide ($Sb_2O_3$), barium oxide (BaO), strontium oxide (SrO) and lead oxide (PbO).

It has been discovered according to the present invention that a higher n-value both in a region of current higher than 10A/cm$^2$ and in a current region between 0.1mA and 1mA, a higher power dissipation for a surge pulse and a lower C-value can be obtained when said sintered body comprises, as a main constitutent, zinc oxide (ZnO), and, as additives, 0.01 to 10 mole percent of bismuth oxide ($Bi_2O_3$), 0.1 to 3.0 mole percent of cobalt oxide (CoO), 0.1 to 3.0 mole percent of manganese oxide (MnO) and at least one member selected from the group consisting of 0.01 to 8.0 mole percent of antimony oxide ($Sb_2O_3$), 0.1 to 5.0 mole percent of tin oxide ($SnO_2$) and 0.02 to 10 mole percent of silicon oxide ($SiO_2$) and at least one member selected from the group consisting of 0.01 to 5.0 mole percent of chromium oxide ($Cr_2O_3$) and 0.01 to 5.0 mole percent of nickel oxide (NiO), and said heat-treating temperature of zinc oxide powder is between 500°C and 1000°C.

The n-value both in a region of current higher than 10A/cm$^2$ and in a region of current between 0.1 mA and 1 mA, the power dissipation for a surge pulse and the C-value of less than 70 volts are further improved when said sintered body comprises, as a main constituent, zinc oxide (ZnO), and, as additives, 0.01 to 5.0 mole percent of bismuth oxide ($Bi_2O_3$), 0.1 to 3.0 mole percent of cobalt oxide (CoO), 0.1 to 3.0 mole percent of manganese oxide (MnO) and at least one member selected from the group consisting of 0.1 to 3.0 mole percent of titanium oxide ($TiO_2$), 0.01 to 5.0 mole percent of nickel oxide (NiO), 0.01 to 5.0 mole percent of chromium oxide ($Cr_2O_3$), 0.01 to 5.0 mole percent of barium oxide (BaO) and 0.01 to 5.0 mole percent of boron oxide ($B_2O_3$), and said heat-treating temperature of zinc oxide powder is between 500°C and 1000°C.

It has been discovered according to the present invention that the n-value both in a region of current higher than 10A/cm$^2$ and in a region of current between 0.1mA and 1mA, the power dissipation for a surge pulse and the C-value have been remarkably improved when said heat-treating temperature of zinc oxide powder is between 700°C and 800°C and said sintered body comprises, as a main constituent, zinc oxide (ZnO), and, as additives, either 0.01 to 10 mole percent of bismuth oxide ($Bi_2O_3$), 0.1 to 3.0 mole percent of cobalt oxide (CoO), 0.1 to 3.0 mole percent of manganese oxide (MnO) and at least one member selected from the group consisting of 0.01 to 8.0 mole percent of antimony oxide ($Sb_2O_3$), 0.1 to 5.0 mole percent of tin oxide ($SnO_2$), and 0.01 to 10 mole percent of silicon oxide ($SiO_2$), and at least one member selected from the group consisting of 0.01 to 5.0 mole percent of chromium oxide ($Cr_2O_3$), 0.01 to 5.0 mole percent of nickel oxide (Nio), or 0.01 to 5.0 mole percent of bismuth oxide ($Bi_2O_3$), 0.1 to 3.0 mole percent of cobalt oxide (CoO), 0.1 to 3.0 mole percent of manganese oxide (MnO) and at least one member selected from the group consisting of 0.1 to 3.0 mole percent of titanium oxide ($TiO_2$), 0.01 to 5.0 mole percent of nickel oxide (NiO), 0.01 to 5.0 mole percent of chromium oxide ($Cr_2O_3$), 0.01 to 5.0 mole percent of barium oxide (BaO) and 0.01 to 5.0 mole percent of boron oxide ($B_2O_3$).

The heat-treating process for the zinc oxide powder can be carried out by any suitable and available method such as firing said zinc oxide powder which is packed in a alumina crucible or sagger at a given heat-treating temperature between 500°C and 1000°C for a given time. Said zinc oxide powder used is a high grade or industrial grade zinc oxide and it contains less than 0.01 mole percent of impurity (without any dopant) added before the heat-treating process. It is not always advantageous that calcination of the mixture of zinc oxide with one or more additives be carried out. The heat-treating of the zinc oxide powder before mixing the zinc oxide and the additives is necessary to achieve the higher n-value both in a region of current higher than 10A/cm and in a region of current between 0.1mA and 1mA, the higher power dissipation for a surge pulse and the lower C-value which are the advantages of the present invention.

The sintered body 1 can be prepared by a per se well known ceramic technique. The starting materials in the compositions in the foregoing description are mixed in a wet mill so as to produce homegeneous mixtures. The mixtures are dried and pressed in a mold into desired shapes at a pressure from 50 kg./cm² to 500 kg/cm². The pressed bodies are sintered in air at 1000°C to 1450°C for 1 to 20 hours, and then furnace-cooled to room temperature (about 15°C to about 30°C). The mixture can be preliminarily calcined at 600 to 1000°C and pulverized for easy fabrication in a subsequent pressing step. The mixture to be pressed can be admixed with a suitable binder such as water, polyvinyl alcohol, etc. It is advantageous that the sintered body be lapped at the opposite surfaces by abrasive powder such as silicon carbide with a particle size of about 10 to 50μ in mean diameter. The sintered bodies are provided, at the opposite surfaces thereof, with electrodes in any available and by any suitable method such as silver painting, vacuum evaporation or flame spraying of metal such as Al, Zn, Sn, etc.

The voltage-dependent properties are not affected in a practical way by the kind of electrodes used, but are affected by the thickness of the sintered bodies. Particularly, the C-value varies in proportion to the thickness of the sintered bodies, while the n-value is almost independent of the thickness. This surely means that the voltage-dependent property is due to the bulk itself, but not to the electrodes.

Lead wires can be attached to the electrodes in a per se conventional manner by using conventional solder. It is convenient to employ a conductive adhesive comprising silver powder and resin in an organic solvent in order to connect the lead wires to the electrodes. Voltage-dependent resistors according to this invention have a high stability in a surge test which is carried out by applying a surge wave having a form of 8×20μsec and 1000A/cm². The n-value does not change significantly after the heating cycles, the load life test, a humidity test and a surge life test. It is advantageous for achievement of high stability with respect to humidity that the resultant voltage-dependent resistors be embedded in a humidity proof resin such as epoxy resin and phenol resin in a per se well known manner.

The following examples are meant to illustrate preferred embodiments of this invention, but not meant to limit the scope thereof.

EXAMPLE 1

Zinc oxide was heat-treated in air for 2 hours at the temperatures listed in Table 1. The slurry was dried and pressed in a mold into discs 17.5 mm in diameter and 2 mm in thickness at a pressure of 250 kg/cm². The pressed bodies were sintered in air at temperatures listed in Table 1 and then furnace-cooled to room temperature. The zinc oxide sintered bodies were lapped on the opposite surfaces thereof to a thickness of 1 mm by silicone carbide abrasive having particle size of 30 μ in mean diameter. The opposite surfaces of the sintered body were provided with a spray metallized film of aluminum by a per se well known technique.

The electrical characteristics of the resultant sintered bodies are shown in Table 1. The zinc oxide sintered bodies have an ohmic property and have a specific resistivity less than 3Ω-cm. It is easily understood that the heat-treating temperature between 700°C and 800°C is preferable for lower specific resistivity.

Table 1

| Heat-treating temperature of zinc oxide powder (°C) | Sintering | | Specific resislivity of zinc oxide sintered body (Ω-cm) |
|---|---|---|---|
| | Temperature (°C) | Time (hr) | |
| 500 | 1000 | 20 | 2.5 |
| | 1200 | 10 | 1.2 |
| | 1350 | 2 | 0.9 |
| | 1450 | 1 | 0.3 |
| 600 | 1000 | 20 | 0.5 |
| | 1200 | 10 | 0.3 |
| | 1350 | 2 | 0.25 |
| | 1450 | 1 | 0.12 |
| 700 | 1000 | 20 | 0.09 |
| | 1200 | 10 | 0.08 |
| | 1350 | 2 | 0.06 |
| | 1450 | 1 | 0.06 |
| 750 | 1000 | 20 | 0.07 |
| | 1200 | 10 | 0.07 |
| | 1350 | 2 | 0.06 |
| | 1450 | 1 | 0.05 |
| 800 | 1000 | 20 | 0.08 |
| | 1200 | 10 | 0.07 |
| | 1350 | 2 | 0.06 |
| | 1450 | 1 | 0.06 |
| 900 | 1000 | 20 | 0.5 |
| | 1200 | 10 | 0.3 |
| | 1350 | 2 | 0.2 |
| | 1450 | 1 | 0.09 |
| 1000 | 1000 | 20 | 3.0 |
| | 1200 | 10 | 1.0 |
| | 1350 | 2 | 0.7 |
| | 1450 | 1 | 0.3 |

EXAMPLE 2

Zinc oxide powder was heat-treated, first of all, under the condition listed in Table 2. The heat-treated zinc oxide was pulverized and dried by the same process as that of Example 1. The heat-treated zinc oxide fine powder and additives listed in Table 2 were mixed in a wet mill for 24 hours. The mixture was dried and pressed in a mold into discs 17.5 mm in diameter and 25 mm in thickness at a pressure of 250 kg/cm².

The pressed bodies were sintered in air under the conditions shown in Table 2, and then furnace-cooled to room temperature. The sintered bodies were lapped on the opposite surfaces thereof to a thickness shown in Table 2 by silicon carbide abrasive having a particle size of 30$\mu$ in mean diameter. The opposite surfaces of the sintered bodies were provided with a spray metallized film of aluminum by a per se well known technique.

The electric characteristics of the resultant sintered bodies are shown in Table 2, which shows that the C-value varies approximately in proportion to the thickness of the sintered body while the n-value is essentially independent of the thickness. It will be readily recognized that the voltage-dependent property of the sintered body is attributed to the sintered body itself.

Table 2

| Heat-treating of zinc oxide powder | | Composition (mole %) | | | Sintering | | Thickness | Electrical properties of resultant resistor | |
|---|---|---|---|---|---|---|---|---|---|
| Temperature (°C) | Time (hrs.) | ZnO | Additive | | Temperature (°C) | Time (hrs.) | (mm) | C at a given current of 1mA (V) | 0.1mA"1mA |
| 750 | 2 | 99.5 | $Bi_2O_3$ | 0.5 | 1000 | 3 | 20 | 730 | 9.2 |
| 750 | 2 | 99.5 | $Bi_2O_3$ | 0.5 | 1200 | 1 | 10 | 360 | 9.1 |
| 750 | 2 | 99.5 | $Bi_2O_3$ | 0.5 | 1200 | 1 | 3 | 110 | 9.0 |
| 500 | 10 | 99.5 | $Bi_2O_3$ | 0.5 | 1200 | 1 | 20 | 750 | 8.8 |
| 700 | 2 | 99.5 | $Bi_2O_3$ | 0.5 | 1200 | 1 | 20 | 733 | 9.2 |
| 800 | 2 | 99.5 | $Bi_2O_3$ | 0.5 | 1200 | 1 | 20 | 740 | 9.2 |
| 1000 | 1 | 99.5 | $Bi_2O_3$ | 0.5 | 1200 | 1 | 20 | 790 | 8.9 |
| 750 | 2 | 97.0 | $Bi_2O_3$ | 3.0 | 1200 | 3 | 1 | 40 | 9.3 |
| 750 | 2 | 97.0 | $Bi_2O_3$ | 3.0 | 1200 | 3 | 3 | 120 | 9.5 |
| 750 | 2 | 97.0 | $Bi_2O_3$ | 3.0 | 1200 | 3 | 10 | 400 | 9.7 |
| 500 | 10 | 97.0 | $Bi_2O_3$ | 3.0 | 1200 | 3 | 20 | 815 | 9.8 |
| 700 | 2 | 97.0 | $Bi_2O_3$ | 3.0 | 1200 | 3 | 20 | 800 | 10.2 |
| 800 | 2 | 97.0 | $Bi_2O_3$ | 3.0 | 1200 | 3 | 20 | 800 | 10.3 |
| 1000 | 1 | 97.0 | $Bi_2O_3$ | 3.0 | 1200 | 3 | 20 | 820 | 9.9 |
| 750 | 2 | 99.5 | CoO | 0.5 | 1000 | 2 | 1 | 96 | 5.0 |
| 750 | 2 | 99.5 | CoO | 0.5 | 1000 | 2 | 3 | 290 | 5.0 |
| 750 | 2 | 99.5 | CoO | 0.5 | 1000 | 2 | 10 | 965 | 5.2 |
| 750 | 2 | 99.5 | CoO | 0.5 | 1000 | 2 | 20 | 1930 | 5.4 |
| 500 | 20 | 97.0 | CoO | 3.0 | 1100 | 1 | 20 | 260 | 4.0 |
| 700 | 2 | 97.0 | CoO | 3.0 | 1100 | 1 | 20 | 220 | 4.5 |
| 800 | 2 | 97.0 | CoO | 3.0 | 1100 | 1 | 20 | 220 | 4.7 |
| 1000 | 1 | 97.0 | CoO | 3.0 | 1100 | 1 | 20 | 240 | 4.0 |
| 750 | 2 | 99.5 | $UO_2$ | 0.5 | 1350 | 1 | 1 | 40 | 6.1 |
| 750 | 2 | 99.5 | $UO_2$ | 0.5 | 1350 | 1 | 3 | 122 | 6.4 |
| 750 | 2 | 99.5 | $UO_2$ | 0.5 | 1350 | 1 | 10 | 400 | 6.6 |
| 750 | 2 | 99.5 | $UO_2$ | 0.5 | 1350 | 1 | 20 | 805 | 6.8 |
| 750 | 2 | 95.0 | $SnO_2$ | 5.0 | 1300 | 1 | 1 | 7 | 3.4 |
| 750 | 2 | 95.0 | $SnO_2$ | 5.0 | 1300 | 1 | 3 | 20 | 3.5 |
| 750 | 2 | 95.0 | $SnO_2$ | 5.0 | 1300 | 1 | 10 | 67 | 3.7 |
| 750 | 2 | 95.0 | $SnO_2$ | 5.0 | 1300 | 1 | 20 | 130 | 3.8 |
| 750 | 2 | 99.5 | MnO | 0.5 | 1200 | 1 | 1 | 127 | 6.6 |
| 750 | 2 | 99.5 | MnO | 0.5 | 1200 | 1 | 3 | 380 | 6.6 |
| 750 | 2 | 99.5 | MnO | 0.5 | 1200 | 1 | 10 | 1270 | 6.7 |
| 500 | 10 | 99.5 | MnO | 0.5 | 1200 | 1 | 20 | 1300 | 5.9 |
| 700 | 2 | 99.5 | MnO | 0.5 | 1200 | 1 | 20 | 1275 | 6.6 |
| 800 | 2 | 99.5 | MnO | 0.5 | 1200 | 1 | 20 | 1279 | 6.6 |
| 1000 | 1 | 99.5 | MnO | 0.5 | 1200 | 1 | 20 | 1340 | 5.7 |
| 750 | 2 | 97.0 | MnO | 3.0 | 1000 | 5 | 20 | 3170 | 6.0 |
| 750 | 2 | 97.0 | MnO | 3.0 | 1200 | 2 | 3 | 480 | 7.5 |
| 750 | 2 | 97.0 | MnO | 3.0 | 1200 | 2 | 10 | 1580 | 6.7 |
| 500 | 10 | 97.0 | MnO | 3.0 | 1200 | 2 | 20 | 3300 | 6.0 |
| 700 | 2 | 97.0 | MnO | 3.0 | 1200 | 2 | 20 | 3200 | 6.7 |
| 800 | 2 | 97.0 | MnO | 3.0 | 1200 | 2 | 20 | 3210 | 6.7 |
| 1000 | 1 | 97.0 | MnO | 3.0 | 1200 | 2 | 20 | 3360 | 5.9 |
| 750 | 5 | 99.5 | $Sb_2O_3$ | 0.5 | 1000 | 3 | 20 | 1070 | 4.2 |
| 750 | 5 | 99.5 | $Sb_2O_3$ | 0.5 | 1200 | 1 | 3 | 162 | 4.0 |
| 750 | 5 | 99.5 | $Sb_2O_3$ | 0.5 | 1200 | 1 | 10 | 535 | 4.0 |
| 500 | 10 | 99.5 | $Sb_2O_3$ | 0.5 | 1200 | 1 | 20 | 1100 | 3.7 |
| 700 | 5 | 99.5 | $Sb_2O_3$ | 0.5 | 1200 | 1 | 20 | 1075 | 4.1 |
| 800 | 5 | 99.5 | $Sb_2O_3$ | 0.5 | 1200 | 1 | 20 | 1080 | 4.1 |
| 1000 | 2 | 99.5 | $Sb_2O_3$ | 0.5 | 1200 | 1 | 20 | 1150 | 3.9 |
| 750 | 5 | 97.0 | $Sb_2O_3$ | 3.0 | 1200 | 2 | 1 | 108 | 3.9 |
| 750 | 5 | 97.0 | $Sb_2O_3$ | 3.0 | 1200 | 2 | 3 | 325 | 3.9 |
| 750 | 5 | 97.0 | $Sb_2O_3$ | 3.0 | 1200 | 2 | 10 | 1085 | 3.9 |
| 500 | 10 | 97.0 | $Sb_2O_3$ | 3.0 | 1200 | 2 | 20 | 2200 | 3.0 |
| 700 | 5 | 97.0 | $Sb_2O_3$ | 3.0 | 1200 | 2 | 20 | 2170 | 3.9 |
| 800 | 5 | 97.0 | $Sb_2O_3$ | 3.0 | 1200 | 2 | 20 | 2170 | 3.9 |
| 1000 | 2 | 97.0 | $Sb_2O_3$ | 3.0 | 1200 | 2 | 20 | 2220 | 3.1 |
| 750 | 2 | 99.5 | BaO | 0.5 | 1100 | 3 | 20 | 650 | 10.6 |
| 750 | 2 | 99.5 | BaO | 0.5 | 1300 | 1 | 3 | 98 | 10.5 |
| 750 | 2 | 99.5 | BaO | 0.5 | 1300 | 1 | 10 | 320 | 10.7 |
| 500 | 10 | 99.5 | BaO | 0.5 | 1300 | 1 | 20 | 700 | 9.5 |
| 700 | 2 | 99.5 | BaO | 0.5 | 1300 | 1 | 20 | 650 | 10.4 |
| 800 | 2 | 99.5 | BaO | 0.5 | 1300 | 1 | 20 | 650 | 10.4 |
| 1000 | 1 | 99.5 | BaO | 0.5 | 1300 | 1 | 20 | 710 | 9.2 |
| 750 | 2 | 97.0 | BaO | 3.0 | 1300 | 2 | 1 | 96 | 7.7 |
| 750 | 2 | 97.0 | BaO | 3.0 | 1300 | 2 | 2 | 295 | 7.8 |
| 750 | 2 | 97.0 | BaO | 3.0 | 1300 | 2 | 10 | 980 | 7.8 |
| 500 | 10 | 97.0 | BaO | 3.0 | 1300 | 2 | 20 | 2005 | 6.9 |
| 700 | 2 | 97.0 | BaO | 3.0 | 1300 | 2 | 20 | 1970 | 7.5 |
| 800 | 2 | 97.0 | BaO | 3.0 | 1300 | 2 | 20 | 1972 | 7.5 |
| 1000 | 1 | 97.0 | BaO | 3.0 | 1300 | 2 | 20 | 2010 | 6.8 |

Table 2-continued

| Heat-treating of zine oxide powder | | Composition (mole %) | | | Sintering | | Thickness | Electrical properties of resultant resistor | |
|---|---|---|---|---|---|---|---|---|---|
| Temperature (°C) | Time (hrs.) | ZnO | Additive | | Temperature (°C) | Time (hrs.) | (mm) | C at a given current of 1mA (V) | 0.1mA"1mA |
| 750 | 5 | 99.5 | SrO | 0.5 | 1100 | 5 | 20 | 469 | 8.2 |
| 750 | 5 | 99.5 | SrO | 0.5 | 1300 | 1 | 3 | 71 | 8.0 |
| 750 | 5 | 99.5 | SrO | 0.5 | 1300 | 1 | 10 | 235 | 8.2 |
| 500 | 10 | 99.5 | SrO | 0.5 | 1300 | 1 | 20 | 510 | 7.5 |
| 700 | 5 | 99.5 | SrO | 0.5 | 1300 | 1 | 20 | 470 | 8.1 |
| 800 | 5 | 99.5 | SrO | 0.5 | 1300 | 1 | 20 | 470 | 8.1 |
| 1000 | 2 | 99.5 | SrO | 0.5 | 1300 | 1 | 20 | 505 | 7.6 |
| 750 | 5 | 97.0 | SrO | 3.0 | 1300 | 2 | 1 | 58 | 6.5 |
| 750 | 5 | 97.0 | SrO | 3.0 | 1300 | 2 | 3 | 175 | 6.6 |
| 750 | 5 | 97.0 | SrO | 3.0 | 1300 | 2 | 10 | 578 | 6.6 |
| 500 | 10 | 97.0 | SrO | 3.0 | 1300 | 2 | 20 | 1200 | 5.5 |
| 700 | 5 | 87.5 | SrO | 3.0 | 1300 | 2 | 20 | 1170 | 6.5 |
| 800 | 5 | 97.0 | SrO | 3.0 | 1300 | 2 | 20 | 1172 | 6.4 |
| 1000 | 2 | 97.0 | SrO | 3.0 | 1300 | 2 | 20 | 1230 | 5.3 |
| 750 | 2 | 99.5 | PbO | 0.5 | 1100 | 5 | 20 | 1315 | 9.4 |
| 750 | 2 | 99.5 | PbO | 0.5 | 1300 | 1 | 3 | 1995 | 9.2 |
| 750 | 2 | 99.5 | PbO | 0.5 | 1300 | 1 | 10 | 6584 | 9.3 |
| 500 | 10 | 99.5 | PbO | 0.5 | 1300 | 1 | 20 | 1400 | 8.5 |
| 700 | 2 | 99.5 | PbO | 0.5 | 1300 | 1 | 20 | 1320 | 8.3 |
| 800 | 2 | 99.5 | PbO | 0.5 | 1300 | 1 | 20 | 1322 | 9.3 |
| 1000 | 1 | 99.5 | PbO | 0.5 | 1300 | 1 | 20 | 1420 | 8.2 |
| 750 | 2 | 97.0 | PbO | 3.0 | 1300 | 2 | 1 | 640 | 8.3 |
| 750 | 2 | 97.0 | PbO | 3.0 | 1300 | 2 | 3 | 1920 | 8.5 |
| 750 | 2 | 97.0 | PbO | 3.0 | 1300 | 2 | 10 | 6405 | 8.6 |
| 500 | 10 | 97.0 | PbO | 3.0 | 1300 | 2 | 20 | 1400 | 7.2 |
| 700 | 2 | 97.0 | PbO | 3.0 | 1300 | 2 | 20 | 1290 | 8.5 |
| 800 | 2 | 97.0 | PbO | 3.0 | 1300 | 2 | 20 | 1289 | 8.4 |
| 1000 | 1 | 97.0 | PbO | 3.0 | 1300 | 2 | 20 | 1380 | 7.6 |

EXAMPLE 3

Zinc oxide and additives of Table 3 were fabricated into voltage-dependent resistors by the same process as that of Example 2. The electrical properties of the resultant resistors are shown in Table 3 in which the values of $n_1$ and $n_2$ are the n-value defined between 0.1mA and 1mA, and between 10A and 100A, respectively. The thickness is 1mm. The change rates of C and n-values after an impulse test are also shown in Table 3. The impulse test is carried out by applying 2 impulses of 8×20 $\mu$s, 1000A. It will be readily recognized that the heat-treating of zinc oxide powder results in the high n-value, low C-value and small change rates, especially for a C-value lower than 70 volts.

Table 3

| Heat-treating of zinc oxide powder | | Additives (mole%) | | | Sintering | | Electrical characteristics of Resultant Resistor | | | change Rate after Impulse Test (%) | | |
|---|---|---|---|---|---|---|---|---|---|---|---|---|
| Temp. (°C) | Time (hrs.) | $Bi_2O_3$ | other additives | | Temp. (°C) | Time (hrs.) | C (At a given) current of 1mA (V) | $n_1$ | $n_2$ | ΔC (at a given current of 1mA (V) | $\Delta n_1$ | $\Delta n_2$ |
| 750 | 2 | 0.01 | CoO | 0.1 | 1300 | 1 | 20 | 8 | 6 | −19 | −18 | −9.2 |
| 750 | 2 | 0.1 | CoO | 0.5 | 1300 | 1 | 27 | 13 | 11 | −18 | −19 | −9.5 |
| 750 | 2 | 0.5 | CoO | 0.5 | 1300 | 1 | 35 | 17 | 15 | −17 | −17 | −7.1 |
| 750 | 2 | 1.0 | CoO | 0.5 | 1300 | 1 | 41 | 15 | 12 | −19 | −19 | −9.3 |
| 750 | 2 | 10.0 | CoO | 10.0 | 1300 | 2 | 61 | 9 | 7 | −18 | −19 | −9.5 |
| 500 | 10 | 0.5 | CoO | 0.5 | 1300 | 1 | 40 | 15 | 13 | −17 | −18 | −8.9 |
| 700 | 2 | 0.5 | CoO | 0.5 | 1300 | 1 | 36 | 17 | 14 | −17 | −17 | −8.2 |
| 800 | 2 | 0.5 | CoO | 0.5 | 1300 | 1 | 37 | 17 | 14 | −17 | −17 | −8.3 |
| 1000 | 1 | 0.5 | CoO | 0.5 | 1300 | 1 | 43 | 15 | 13 | −17 | −18 | −8.9 |
| 500 | 10 | 0.5 | PbO | 0.5 | 1300 | 1 | 730 | 7 | 5 | −19 | −19 | −9.2 |
| 700 | 5 | 0.5 | PbO | 0.5 | 1300 | 1 | 650 | 8 | 6 | −16 | −17 | −8.3 |
| 800 | 5 | 0.5 | PbO | 0.5 | 1300 | 1 | 645 | 8 | 6 | −17 | −16 | −8.4 |
| 1000 | 2 | 0.5 | PbO | 0.5 | 1300 | 1 | 750 | 7 | 5 | −18 | −19 | −9.1 |
| 750 | 2 | 0.01 | MnO | 0.1 | 1300 | 1 | 19 | 6 | 6 | −20 | −19 | −9.3 |
| 750 | 2 | 0.1 | MnO | 0.5 | 1300 | 1 | 129 | 11 | 9 | −19 | −20 | −9.2 |
| 750 | 2 | 0.5 | MnO | 0.5 | 1300 | 1 | 64 | 17 | 15 | −16 | −15 | −8.1 |
| 750 | 2 | 1.0 | MnO | 0.5 | 1300 | 1 | 146 | 7 | 6 | −18 | −19 | −9.3 |
| 750 | 2 | 10.0 | MnO | 10.0 | 1300 | 2 | 230 | 6 | 4 | −19 | −18 | − 9.4 |
| 500 | 10 | 0.5 | MnO | 0.5 | 1300 | 1 | 80 | 14 | 12 | −17 | −17 | −8.4 |
| 700 | 2 | 0.5 | MnO | 0.5 | 1300 | 1 | 65 | 16 | 15 | −16 | −15 | −8.1 |
| 800 | 2 | 0.5 | MnO | 0.5 | 1300 | 1 | 68 | 16 | 15 | −16 | −15 | −8.2 |
| 1000 | 1 | 0.5 | MnO | 0.5 | 1300 | 1 | 75 | 12 | 10 | −17 | −17 | −8.5 |
| 750 | 2 | 0.5 | $Sb_2O_3$ | 0.1 | 1350 | 1 | 25 | 16 | 14 | −18 | −17 | −9.7 |
| 750 | 2 | 0.01 | $Sb_2O_3$ | 0.01 | 1350 | 1 | 43 | 14 | 12 | −18 | −17 | −9.6 |
| 750 | 2 | 0.1 | $Sb_2O_3$ | 1.0 | 1350 | 1 | 52 | 19 | 15 | −19 | −19 | −9.5 |
| 750 | 2 | 0.5 | $Sb_2O_3$ | 1.0 | 1350 | 1 | 63 | 20 | 17 | −15 | −15 | −8.0 |
| 750 | 2 | 1.0 | $Sb_2O_3$ | 1.0 | 1350 | 1 | 70 | 21 | 15 | −17 | −18 | −9.4 |
| 750 | 2 | 10.0 | $Sb_2O_3$ | 1.0 | 1350 | 2 | 80 | 23 | 16 | −19 | −20 | −9.3 |
| 750 | 2 | 10.0 | $Sb_2O_3$ | 10.0 | 1350 | 2 | 90 | 25 | 16 | −20 | −19 | −9.2 |
| 500 | 5 | 0.5 | $Sb_2O_3$ | 1.0 | 1350 | 1 | 70 | 78 | 15 | −16 | −16 | −8.2 |
| 700 | 2 | 0.5 | $Sb_2O_3$ | 1.0 | 1350 | 1 | 65 | 19 | 17 | −15 | −15 | −8.1 |
| 800 | 2 | 0.5 | $Sb_2O_3$ | 1.0 | 1350 | 1 | 65 | 19 | 17 | −15 | −15 | −8.1 |
| 1000 | 1 | 0.5 | $Sb_2O_3$ | 1.0 | 1350 | 1 | 72 | 17 | 15 | −17 | −16 | −8.4 |
| 750 | 2 | 0.5 | $Sb_2O_3$ | 0.01 | 1350 | 1 | 51 | 13 | 12 | −18 | −19 | −9.5 |
| 750 | 2 | 0.5 | BaO | 0.1 | 1350 | 1 | 50 | 14 | 12 | −19 | −19 | −9.4 |

Table 3-continued

| Heat-treating of zinc oxide powder | | Additives (mole%) | | | Sintering | | Electrical characteristics of Resultant Resistor | | | change Rate after Impulse Test (%) | | |
|---|---|---|---|---|---|---|---|---|---|---|---|---|
| Temp. (°C) | Time (hrs.) | $Bi_2O_3$ | other additives | | Temp. (°C) | Time (hrs.) | C (At a given) current of 1mA (V) | $n_1$ | $n_2$ | ΔC (at a given current of 1mA (V) | $\Delta n_1$ | $\Delta n_2$ |
| 750 | 2 | 0.5 | BaO | 0.5 | 1350 | 1 | 60 | 16 | 14 | −16 | −16 | −7.9 |
| 750 | 2 | 0.5 | BaO | 2.0 | 1350 | 1 | 72 | 18 | 16 | −19 | −20 | −9.1 |
| 750 | 2 | 0.5 | BaO | 10.0 | 1350 | 1 | 85 | 20 | 18 | −19 | −20 | −9.5 |
| 500 | 10 | 0.5 | BaO | 0.5 | 1350 | 1 | 65 | 15 | 15 | −16 | −17 | −8.1 |
| 700 | 2 | 0.5 | BaO | 0.5 | 1350 | 1 | 62 | 15 | 13 | −16 | −16 | −7.9 |
| 800 | 2 | 0.5 | BaO | 0.5 | 1350 | 1 | 61 | 15 | 14 | −16 | −16 | −7.9 |
| 1000 | 1 | 0.5 | BaO | 0.5 | 1350 | 1 | 65 | 14 | 12 | −16 | −18 | −8.0 |
| 750 | 2 | 0.01 | SrO | 0.01 | 1350 | 1 | 24 | 7 | 5 | −20 | −19 | −9.7 |
| 750 | 2 | 0.1 | SrO | 0.5 | 1350 | 1 | 30 | 7 | 5 | −20 | −20 | −9.8 |
| 750 | 2 | 0.5 | SrO | 0.5 | 1350 | 1 | 4 | 10 | 6 | −15 | −16 | −7.5 |
| 750 | 2 | 1.0 | SrO | 0.5 | 1350 | 1 | 14 | 7 | 5 | −18 | −19 | −9.5 |
| 750 | 2 | 10.0 | SrO | 0.5 | 1350 | 1 | 23 | 7 | 5 | −19 | −20 | −9.8 |
| 750 | 2 | 10.0 | SrO | 10.0 | 1350 | 2 | 42 | 7 | 5 | −19 | −20 | −9.9 |
| 500 | 10 | 0.5 | SrO | 0.5 | 1350 | 1 | 5 | 9 | 4 | −16 | −17 | −7.6 |
| 700 | 2 | 0.5 | SrO | 0.5 | 1350 | 1 | 4 | 10 | 5 | −15 | −16 | −7.4 |
| 800 | 2 | 0.5 | SrO | 0.5 | 1350 | 1 | 4 | 10 | 5 | −15 | −16 | −7.4 |
| 1000 | 2 | 0.5 | SrO | 0.5 | 1350 | 1 | 5 | 9 | 4 | −16 | −17 | −7.8 |
| 750 | 2 | 0.5 | CoO<br>MnO | 0.5<br>0.01 | 1350 | 1 | 73 | 16 | 14 | −15 | −14 | −7.0 |
| 750 | 2 | 0.5 | CoO<br>MnO | 0.5<br>0.5 | 1350 | 1 | 104 | 18 | 16 | −12 | −11 | −4.5 |
| 750 | 2 | 0.5 | CoO<br>MnO | 0.5<br>5.0 | 1350 | 1 | 125 | 17 | 15 | −15 | −15 | −6.5 |
| 750 | 2 | 0.5 | CoO<br>MnO | 0.05<br>0.5 | 1350 | 1 | 93 | 17 | 15 | −14 | −15 | −6.7 |
| 750 | 2 | 0.5 | CoO<br>MnO | 1.0<br>0.5 | 1350 | 1 | 106 | 19 | 17 | −14 | −14 | −6.8 |
| 750 | 2 | 0.5 | CoO<br>MnO | 9.5<br>0.5 | 1300 | 2 | 130 | 18 | 16 | −15 | −15 | −6.9 |
| 500 | 10 | 0.5 | CoO<br>MnO | 0.5<br>0.5 | 1350 | 1 | 110 | 17 | 15 | −15 | −12 | −5.8 |
| 700 | 2 | 0.5 | CoO<br>MnO | 0.5<br>0.5 | 1350 | 1 | 105 | 17 | 16 | −12 | −11 | −4.6 |
| 800 | 2 | 0.5 | CoO<br>MnO | 0.5<br>0.5 | 1350 | 1 | 106 | 17 | 16 | −12 | −11 | −4.5 |
| 1000 | 1 | 0.5 | CoO<br>MnO | 0.5<br>0.5 | 1350 | 1 | 115 | 16 | 14 | −14 | −12 | −5.9 |
| 700 | 2 | 0.5 | CoO<br>BaO | 0.5<br>0.5 | 1300 | 2 | 58 | 26 | 17 | −12 | −12 | −4.6 |
| 700 | 2 | 0.5 | CoO<br>BaO | 0.5<br>9.5 | 1300 | 2 | 102 | 23 | 14 | −15 | −14 | −6.3 |
| 800 | 1 | 0.5 | CoO<br>BaO | 9.5<br>0.5 | 1300 | 2 | 92 | 22 | 13 | −15 | −15 | −6.5 |
| 500 | 5 | 0.5 | CoO<br>BaO | 0.5<br>0.5 | 1300 | 2 | 61 | 24 | 15 | −13 | −13 | −5.2 |
| 800 | 2 | 0.5 | CoO<br>BaO | 0.5<br>0.5 | 1300 | 2 | 59 | 25 | 16 | −12 | −12 | −4.7 |
| 1000 | 2 | 0.5 | CoO<br>BaO | 0.5<br>0.5 | 1300 | 2 | 59 | 25 | 16 | −15 | −13 | −5.1 |
| 700 | 2 | 0.5 | CoO<br>$Sb_2O_3$ | 0.5<br>0.5 | 1350 | 1 | 180 | 30 | 19 | −11 | −12 | −3.4 |
| 700 | 2 | 0.5 | CoO<br>$Sb_2O_3$ | 0.5<br>9.5 | 1350 | 1 | 350 | 26 | 17 | −15 | −15 | −5.5 |
| 700 | 2 | 0.5 | CoO<br>$Sb_2O_3$ | 9.5<br>0.5 | 1350 | 1 | 250 | 27 | 18 | −14 | −15 | −5.2 |
| 500 | 10 | 0.5 | CoO<br>$Sb_2O_3$ | 0.5<br>0.5 | 1350 | 1 | 190 | 29 | 19 | −12 | −13 | −4.2 |
| 800 | 2 | 0.5 | CoO<br>$Sb_2O_3$ | 0.5<br>0.5 | 1350 | 1 | 180 | 30 | 19 | −11 | −12 | −3.5 |
| 1000 | 1 | 0.5 | CoO<br>$Sb_2O_3$ | 0.5<br>0.5 | 1350 | 1 | 185 | 30 | 18 | −12 | −12 | −4.5 |
| 700 | 2 | 0.01 | MnO<br>SrO | 0.005<br>0.005 | 1350 | 1 | 605 | 8 | 6 | −15 | −13 | −5.5 |

Table 3-continued

| Heat-treating of zinc oxide powder | | Additives (mole%) | | | Sintering | | Electrical characteristics of Resultant Resistor | | | change Rate after Impulse Test (%) | | |
|---|---|---|---|---|---|---|---|---|---|---|---|---|
| Temp. (°C) | Time (hrs.) | $Bi_2O_3$ | other additives | | Temp. (°C) | Time (hrs.) | C (At a given) current of 1mA (V) | $n_1$ | $n_2$ | ΔC (at a given current of 1mA (V) | $\Delta n_1$ | $\Delta n_2$ |
| 700 | 2 | 0.01 | MnO | 0.05 | 1350 | 1 | 600 | 9 | 7 | −15 | −15 | −6.2 |
| | | | SrO | 9.95 | | | | | | | | |
| 700 | 2 | 10.0 | MnO | 0.005 | 1350 | 1 | 580 | 8 | 6 | −15 | −14 | −6.3 |
| | | | SrO | 0.005 | | | | | | | | |
| 700 | 2 | 10.0 | MnO | 0.05 | 1350 | 1 | 560 | 8 | 6 | −14 | −15 | −6.5 |
| | | | SrO | 9.95 | | | | | | | | |
| 700 | 2 | 0.05 | MnO | 9.95 | 1350 | 1 | 700 | 8 | 6 | −14 | −15 | −5.5 |
| | | | SrO | 0.05 | | | | | | | | |
| 700 | 2 | 0.05 | MnO | 5.0 | 1350 | 1 | 450 | 9 | 7 | −15 | −15 | −5.3 |
| | | | SrO | 5.0 | | | | | | | | |
| 700 | 2 | 10.0 | MnO | 9.95 | 1350 | 1 | 480 | 8 | 6 | −14 | −15 | −5.2 |
| | | | SrO | 0.05 | | | | | | | | |
| 700 | 2 | 10.0 | MnO | 5.0 | 1350 | 1 | 470 | 9 | 8 | −15 | −14 | −6.1 |
| | | | SrO | 5.0 | | | | | | | | |
| 700 | 2 | 0.1 | MnO | 0.1 | 1350 | 1 | 200 | 10 | 8 | −14 | − 14 | −5.8 |
| | | | SrO | 0.1 | | | | | | | | |
| 700 | 2 | 0.1 | MnO | 0.1 | 1350 | 1 | 200 | 11 | 7 | −15 | −15 | −5.9 |
| | | | SrO | 3.0 | | | | | | | | |
| 700 | 2 | 3.0 | MnO | 0.1 | 1350 | 1 | 200 | 11 | 9 | −15 | −14 | −5.8 |
| | | | SrO | 0.1 | | | | | | | | |
| 700 | 2 | 3.0 | MnO | 0.1 | 1350 | 1 | 190 | 11 | 9 | −16 | −15 | −5.7 |
| | | | SrO | 3.0 | | | | | | | | |
| 700 | 2 | 0.1 | MnO | 3.0 | 1350 | 1 | 210 | 11 | 9 | −15 | −15 | −5.5 |
| | | | SrO | 0.1 | | | | | | | | |
| 700 | 2 | 0.1 | MnO | 3.0 | 1350 | 1 | 205 | 11 | 9 | −16 | −15 | −5.9 |
| | | | SrO | 3.0 | | | | | | | | |
| 700 | 2 | 3.0 | MnO | 9.9 | 1350 | 2 | 210 | 11 | 9 | −16 | −14 | −5.4 |
| | | | SrO | 0.1 | | | | | | | | |
| 700 | 2 | 3.0 | MnO | 3.0 | 1350 | 2 | 205 | 11 | 9 | −15 | −15 | −5.5 |
| | | | SrO | 3.0 | | | | | | | | |
| 700 | 2 | 0.5 | MnO | 0.5 | 1350 | 1 | 70 | 25 | 19 | −11 | −11 | −3.9 |
| | | | SrO | 0.5 | | | | | | | | |
| 500 | 10 | 0.5 | MnO | 0.5 | 1350 | 1 | 75 | 25 | 17 | −12 | −13 | −5.0 |
| | | | SrO | 0.5 | | | | | | | | |
| 800 | 2 | 0.5 | MnO | 0.5 | 1350 | 1 | 72 | 25 | 19 | −11 | −10 | −3.8 |
| | | | SrO | 0.5 | | | | | | | | |
| 1000 | 1 | 0.5 | MnO | 0.5 | 1350 | 1 | 80 | 25 | 17 | −13 | −14 | −5.0 |
| | | | SrO | 0.5 | | | | | | | | |
| 1000 | 1 | 0.5 | CoO | 0.5 | 1350 | 1 | 15 | 28 | 18 | −17 | −15 | −5.8 |
| | | | SrO | 0.5 | | | | | | | | |
| 800 | 2 | 0.5 | CoO | 0.5 | 1350 | 1 | 13 | 28 | 19 | −13 | −12 | −3.5 |
| | | | SrO | 0.5 | | | | | | | | |
| 700 | 2 | 0.5 | CoO | 0.5 | 1350 | 1 | 14 | 28 | 19 | −13 | −13 | −3.6 |
| | | | SrO | 0.5 | | | | | | | | |
| 500 | 10 | 0.5 | CoO | 0.5 | 1350 | 1 | 15 | 27 | 17 | −18 | −14 | −5.7 |
| | | | SrO | 0.5 | | | | | | | | |
| 500 | 10 | 0.5 | MnO | 0.5 | 1350 | 1 | 70 | 26 | 17 | −17 | −16 | −5.8 |
| | | | BaO | 0.5 | | | | | | | | |
| 700 | 2 | 0.5 | MnO | 0.5 | 1350 | 1 | 68 | 26 | 19 | −14 | −12 | −4.1 |
| | | | BaO | 0.5 | | | | | | | | |
| 800 | 2 | 0.5 | MnO | 0.5 | 1350 | 1 | 65 | 26 | 19 | −13 | −12 | −4.0 |
| | | | BaO | 0.5 | | | | | | | | |
| 1000 | 1 | 0.5 | MnO | 0.5 | 1350 | 1 | 71 | 27 | 16 | −16 | −15 | −6.0 |
| | | | BaO | 0.5 | | | | | | | | |
| 500 | 10 | 0.5 | MnO | 0.5 | 1350 | 1 | 155 | 33 | 17 | −15 | −14 | −5.9 |
| | | | $Sb_2O_3$ | 0.5 | | | | | | | | |

Table 3-continued

| Heat-treating of zinc oxide powder | | Additives (mole%) | | | Sintering | | Electrical characteristics of Resultant Resistor | | | change Rate after Impulse Test (%) | | |
|---|---|---|---|---|---|---|---|---|---|---|---|---|
| Temp. (°C) | Time (hrs.) | $Bi_2O_3$ | other additives | | Temp. (°C) | Time (hrs.) | C (At a given) current of 1mA (V) | $n_1$ | $n_2$ | ΔC (at a given current of 1mA (V) | $\Delta n_1$ | $\Delta n_2$ |
| 700 | 2 | 0.5 | MnO | 0.5 | 1350 | 1 | 150 | 33 | 19 | −11 | −11 | −3.8 |
| | | | $Sb_2O_3$ | 0.5 | | | | | | | | |
| 800 | 2 | 0.5 | MnO | 0.5 | 1350 | 1 | 150 | 33 | 19 | −12 | −11 | −3.5 |
| | | | $Sb_2O_3$ | 0.5 | | | | | | | | |
| 1000 | 1 | 0.5 | MnO | 0.5 | 1350 | 1 | 160 | 33 | 17 | −16 | −15 | −6.1 |
| | | | $Sb_2O_3$ | 0.5 | | | | | | | | |
| 700 | 2 | 0.01 | BaO | 0.005 | 1350 | 1 | 380 | 11 | 9 | −17 | −16 | −6.0 |
| | | | SrO | 0.005 | | | | | | | | |
| 700 | 2 | 0.01 | BaO | 0.05 | 1350 | 2 | 390 | 11 | 9 | −17 | −16 | −6.0 |
| | | | SrO | 9.95 | | | | | | | | |
| 700 | 2 | 10.0 | BaO | 0.005 | 1350 | 2 | 350 | 11 | 9 | −16 | −15 | −6.1 |
| | | | SrO | 0.005 | | | | | | | | |
| 700 | 2 | 10.0 | BaO | 0.05 | 1350 | 2 | 400 | 10 | 9 | −15 | −16 | −6.5 |
| | | | SrO | 9.95 | | | | | | | | |
| 700 | 2 | 0.01 | BaO | 9.95 | 1350 | 1 | 380 | 11 | 9 | −17 | −16 | −6.3 |
| | | | SrO | 0.05 | | | | | | | | |
| 700 | 2 | 0.01 | BaO | 5.0 | 1350 | 1 | 375 | 11 | 9 | −16 | −15 | −6.3 |
| | | | SrO | 5.0 | | | | | | | | |
| 700 | 2 | 10.0 | BaO | 9.95 | 1350 | 2 | 35 | 12 | 10 | −17 | −16 | −6.5 |
| | | | SrO | 0.05 | | | | | | | | |
| 700 | 2 | 10.0 | BaO | 5.0 | 1350 | 2 | 30 | 11 | 9 | −17 | −15 | −6.4 |
| | | | SrO | 5.0 | | | | | | | | |
| 500 | 10 | 0.5 | BaO | 0.5 | 1350 | 1 | 23 | 30 | 16 | −13 | −12 | −4.5 |
| | | | SrO | 0.5 | | | | | | | | |
| 700 | 2 | 0.5 | BaO | 0.5 | 1350 | 1 | 21 | 31 | 19 | −12 | −10 | −3.0 |
| | | | SrO | 0.5 | | | | | | | | |
| 800 | 2 | 0.5 | BaO | 0.5 | 1350 | 1 | 21 | 31 | 18 | −12 | −10 | −3.2 |
| | | | SrO | 0.5 | | | | | | | | |
| 1000 | 1 | 0.5 | BaO | 0.5 | 1350 | 1 | 25 | 30 | 16 | −13 | −13 | −4.4 |
| | | | SrO | 0.5 | | | | | | | | |
| 500 | 10 | 0.5 | BaO | 0.5 | 1350 | 1 | 80 | 27 | 16 | −13 | −13 | −4.8 |
| | | | $Sb_2O_3$ | 0.5 | | | | | | | | |
| 700 | 2 | 0.5 | BaO | 0.5 | 1350 | 1 | 73 | 26 | 19 | −11 | −11 | −3.8 |
| | | | $Sb_2O_3$ | 0.5 | | | | | | | | |
| 800 | 2 | 0.5 | BaO | 0.5 | 1350 | 1 | 72 | 26 | 19 | −11 | −11 | −3.9 |
| | | | $Sb_2O_3$ | 0.5 | | | | | | | | |
| 1000 | 1 | 0.5 | BaO | 0.5 | 1350 | 1 | 85 | 28 | 17 | −13 | −12 | −4.9 |
| | | | $Sb_2O_3$ | 0.5 | | | | | | | | |
| 500 | 10 | 0.5 | SrO | 0.5 | 1350 | 1 | 65 | 24 | 15 | −14 | −13 | −4.6 |
| | | | $Sb_2O_3$ | 0.5 | | | | | | | | |
| 700 | 2 | 0.5 | SrO | 0.5 | 1350 | 1 | 60 | 24 | 15 | −11 | −10 | −3.1 |
| | | | $Sb_2O_3$ | 0.5 | | | | | | | | |
| 800 | 2 | 0.5 | SrO | 0.5 | 1350 | 1 | 62 | 24 | 16 | −11 | −10 | −3.2 |
| | | | $Sb_2O_3$ | 0.5 | | | | | | | | |
| 1000 | 1 | 0.5 | SrO | 0.5 | 1350 | 1 | 71 | 25 | 14 | −13 | −13 | −4.8 |
| | | | $Sb_2O_3$ | 0.5 | | | | | | | | |
| 500 | 10 | 0.5 | SrO | 0.5 | 1350 | 1 | 18 | 25 | 16 | −15 | −15 | −4.6 |
| | | | PbO | 0.5 | | | | | | | | |
| 700 | 2 | 0.5 | SrO | 0.5 | 1350 | 1 | 13 | 25 | 18 | −12 | −12 | −3.5 |
| | | | PbO | 0.5 | | | | | | | | |
| 800 | 2 | 0.5 | SrO | 0.5 | 1350 | 1 | 13 | 25 | 18 | −12 | −12 | −3.4 |
| | | | PbO | 0.5 | | | | | | | | |
| 1000 | 1 | 0.5 | SrO | 0.5 | 1350 | 1 | 17 | 26 | 16 | −14 | −15 | −4.5 |
| | | | PbO | 0.5 | | | | | | | | |
| 500 | 10 | 0.5 | BaO | 0.5 | 1350 | 1 | 71 | 20 | 13 | −14 | −13 | −4.7 |
| | | | PbO | 0.5 | | | | | | | | |
| 700 | 2 | 0.5 | BaO | 0.5 | 1350 | 1 | 69 | 21 | 14 | −12 | −11 | −3.3 |
| | | | PbO | 0.5 | | | | | | | | |

Table 3-continued

| Heat-treating of zinc oxide powder | | Additives (mole%) | | | Sintering | | Electrical characteristics of Resultant Resistor | | | change Rate after Impulse Test (%) | | |
|---|---|---|---|---|---|---|---|---|---|---|---|---|
| Temp. (°C) | Time (hrs.) | $Bi_2O_3$ | other additives | | Temp. (°C) | Time (hrs.) | C (At a given) current of 1mA (V) | $n_1$ | $n_2$ | ΔC (at a given current of 1mA (V) | $\Delta n_1$ | $\Delta n_2$ |
| 800 | 2 | 0.5 | BaO | 0.5 | 1350 | 1 | 69 | 21 | 14 | −12 | −10 | −3.7 |
| | | | PbO | 0.5 | | | | | | | | |
| 1000 | 1 | 0.5 | BaO | 0.5 | 1350 | 1 | 75 | 22 | 13 | −13 | −14 | −4.8 |
| | | | PbO | 0.5 | | | | | | | | |
| 500 | 10 | 0.5 | $Sb_2O_3$ | 0.5 | 1350 | 1 | 130 | 20 | 11 | −16 | −15 | −5.0 |
| | | | PbO | 0.5 | | | | | | | | |
| 700 | 2 | 0.5 | $Sb_2O_3$ | 0.5 | 1350 | 1 | 120 | 21 | 13 | −13 | −12 | −3.8 |
| | | | PbO | 0.5 | | | | | | | | |
| 800 | 2 | 0.5 | $Sb_2O_3$ | 0.5 | 1350 | 1 | 118 | 21 | 13 | −13 | −11 | −3.1 |
| | | | PbO | 0.5 | | | | | | | | |
| 1000 | 1 | 0.5 | $Sb_2O_3$ | 0.5 | 1350 | 1 | 125 | 20 | 10 | −15 | −14 | −5.0 |
| | | | Pb0 | 0.5 | | | | | | | | |
| 500 | 10 | 0.5 | MnO | 0.5 | 1350 | 1 | 92 | 22 | 13 | −15 | −16 | −4.5 |
| | | | PbO | 0.5 | | | | | | | | |
| 700 | 2 | 0.5 | MnO | 0.5 | 1350 | 1 | 80 | 22 | 15 | −12 | −13 | −3.3 |
| | | | PbO | 0.5 | | | | | | | | |
| 800 | 2 | 0.5 | MnO | 0.5 | 1350 | 1 | 80 | 22 | 15 | −13 | −12 | −3.1 |
| | | | PbO | 0.5 | | | | | | | | |
| 1000 | 1 | 0.5 | MnO | 0.5 | 1350 | 1 | 90 | 23 | 12 | −16 | −14 | −5.0 |
| | | | PbO | 0.5 | | | | | | | | |
| 500 | 10 | 0.5 | CoO | 0.5 | 1350 | 1 | 75 | 20 | 11 | −14 | −15 | −4.9 |
| | | | PbO | 0.5 | | | | | | | | |
| 700 | 2 | 0.5 | CoO | 0.5 | 1350 | 1 | 70 | 21 | 14 | −11 | −12 | −3.5 |
| | | | PbO | 0.5 | | | | | | | | |
| 800 | 2 | 0.5 | CoO | 0.5 | 1350 | 1 | 72 | 21 | 14 | −11 | −11 | −3.4 |
| | | | PbO | 0.5 | | | | | | | | |
| 1000 | 1 | 0.5 | CoO | 0.5 | 1350 | 1 | 80 | 21 | 12 | −15 | −14 | −5.0 |
| | | | PbO | 0.5 | | | | | | | | |

EXAMPLE 4

Zinc oxide and additives of Table 4 were fabricated into voltage-dependent resistors by the same process as that of Example 2, except the sintering condition was 1350°C for 1 hour. The electrical characteristics of the resulting resistors are shown in Table 4. The change rates of C- and n-values after impulse test carried out by the same method as that of Example 3 are shown in Table 4. It will be easily understood that the heat-treating of zinc oxide powder results in the higher n-value, smaller change rate and low C-value, compared with the above mentioned U.S. Patent applications. The preferred results can be obtained when the heat-treating temperature of the zinc oxide powder is between 700°C and 800°C.

Table 4

| Heat-treating of zinc oxide powder | | Additives (mole %) | | | | | Electrical characteristics of Resultant Resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C (at a given current of 1mA) (V) | $n_1$ | $n_2$ | ΔC (at a given current of 1mA) | $\Delta n_1$ | $\Delta n_2$ |
| 700 | 2 | 0.01 | 0.1 | 0.1 | $Sb_2O_3$ | 0.01 | 45 | 50 | 20 | −9.4 | −10 | −5.3 |
| 700 | 2 | 0.01 | 0.1 | 0.1 | $Sb_2O_3$ | 8.0 | 56 | 51 | 21 | −9.3 | −8.4 | −4.8 |
| 700 | 2 | 0.01 | 3.0 | 0.1 | $Sb_2O_3$ | 0.01 | 42 | 51 | 20 | −8.7 | −9.4 | −4.7 |
| 700 | 2 | 0.01 | 0.1 | 3.0 | $Sb_2O_3$ | 0.01 | 50 | 52 | 22 | −9.5 | −10 | −4.8 |
| 700 | 2 | 0.01 | 3.0 | 3.0 | $Sb_2O_3$ | 0.01 | 58 | 50 | 23 | −8.7 | − 9.7 | −4.9 |
| 700 | 2 | 0.01 | 0.1 | 3.0 | $Sb_2O_3$ | 8.0 | 52 | 52 | 25 | −8.7 | −9.8 | −4.6 |
| 700 | 2 | 0.01 | 3.0 | 0.1 | $Sb_2O_3$ | 8.0 | 51 | 51 | 24 | −9.3 | −8.3 | −4.6 |
| 700 | 2 | 10.0 | 3.0 | 0.1 | $Sb_2O_3$ | 0.01 | 35 | 50 | 24 | −9.5 | −8.2 | −4.9 |
| 700 | 2 | 10.0 | 0.1 | 3.0 | $Sb_2O_3$ | 0.01 | 41 | 52 | 25 | −9.0 | −9.6 | −4.9 |
| 700 | 2 | 10.0 | 0.1 | 0.1 | $Sb_2O_3$ 8.0 | | 48 | 52 | 25 | −8.3 | −9.7 | −5.1 |
| 700 | 2 | 0.01 | 3.0 | 3.0 | $Sb_2O_3$ | 8.0 | 53 | 52 | 25 | −9.6 | −9.9 | −5.2 |
| 700 | 2 | 10.0 | 0.1 | 3.0 | $Sb_2O_3$ | 8.0 | 55 | 50 | 23 | −10 | −8.4 | −4.8 |
| 700 | 2 | 10.0 | 3.0 | 0.1 | $Sb_2O_3$ | 8.0 | 60 | 51 | 24 | −10 | −9.8 | −4.5 |
| 700 | 2 | 10.0 | 3.0 | 3.0 | $Sb_20_3$ | 0.01 | 60 | 53 | 24 | −10 | −10 | −4.1 |
| 700 | 2 | 10.0 | 3.0 | 3.0 | $Sb_2O_3$ | 8.0 | 53 | 53 | 23 | −10 | −9.6 | −3.8 |
| 500 | 10 | 0.5 | 0.5 | 0.5 | $Sb_2O_3$ | 1.0 | 70 | 59 | 24 | −7.2 | −6.4 | −3.7 |
| 700 | 2 | 0.5 | 0.5 | 0.5 | $Sb_2O_3$ | 1.0 | 45 | 60 | 26 | −6.2 | −5.3 | −3.8 |

Table 4-continued

| Heat-treating of zinc oxide powder | | Additives (mole %) | | | | | Electrical characteristics of Resultant Resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C (at a given current of 1mA) (V) | $n_1$ | $n_2$ | ΔC (at a given current of 1mA) | $\Delta n_1$ | $\Delta n_2$ |
| 800 | 2 | 0.5 | 0.5 | 0.5 | $Sb_2O_3$ | 1.0 | 43 | 59 | 25 | −6.4 | −5.2 | −3.9 |
| 1000 | 1 | 0.5 | 0.5 | 0.5 | $Sb_2O_3$ | 1.0 | 65 | 60 | 24 | −7.3 | −6.0 | −4.1 |
| 700 | 2 | 0.01 | 0.1 | 0.1 | $SnO_2$ | 0.1 | 75 | 48 | 20 | −10 | −10 | −4.2 |
| 700 | 2 | 10.0 | 3.0 | 3.0 | $SnO_2$ | 5.0 | 73 | 48 | 21 | −9.5 | −9.9 | −4.3 |
| 500 | 10 | 0.5 | 0.5 | 0.5 | $SnO_2$ | 0.5 | 62 | 50 | 22 | −7.8 | −8.4 | −4.3 |
| 700 | 2 | 0.5 | 0.5 | 0.5 | $SnO_2$ | 0.5 | 50 | 60 | 23 | −5.2 | −5.0 | −3.7 |
| 800 | 2 | 0.5 | 0.5 | 0.5 | $SnO_2$ | 0.5 | 48 | 60 | 24 | −5.3 | −5.2 | −3.0 |
| 1000 | 1 | 0.5 | 0.5 | 0.5 | $SnO_2$ | 0.5 | 58 | 52 | 21 | −8.2 | −7.3 | −4.5 |
| 1000 | 10 | 0.5 | 0.5 | 0.5 | $SiO_2$ | 0.5 | 81 | 40 | 24 | −8.7 | −8.1 | −3.9 |
| 700 | 2 | 0.01 | 0.1 | 0.1 | $SiO_2$ | 0.01 | 78 | 41 | 20 | −8.4 | −9.5 | −4.4 |
| 700 | 2 | 10.0 | 3.0 | 3.0 | $SiO_2$ | 10.0 | 95 | 40 | 21 | −8.0 | −9.2 | −4.2 |
| 500 | 10 | 0.5 | 0.5 | 0.5 | $SiO_2$ | 0.5 | 80 | 42 | 21 | −7.4 | −8.2 | −3.7 |
| 700 | 2 | 0.5 | 0.5 | 0.5 | $SiO_2$ | 0.5 | 60 | 51 | 25 | −5.0 | −5.9 | −2.2 |
| 800 | 2 | 0.5 | 0.5 | 0.5 | $SiO_2$ | 0.5 | 58 | 50 | 26 | −5.2 | −5.6 | −2.1 |
| 1000 | 1 | 0.5 | 0.5 | 0.5 | $SiO_2$ | 0.5 | 70 | 45 | 22 | −9.0 | −8.2 | −3.9 |
| 700 | 2 | 0.5 | 0.5 | 0.5 | $Sb_2O_3$<br>$SnO_2$ | 0.01<br>0.1 | 95 | 70 | 20 | −7.6 | −8.1 | −5.3 |
| 700 | 2 | 0.5 | 0.5 | 0.5 | $Sb_2O_3$<br>$SnO_2$ | 0.1<br>0.5 | 80 | 69 | 21 | −7.3 | −8.0 | −3.1 |
| 700 | 2 | 0.5 | 0.5 | 0.5 | $Sb_2O_3$<br>$SnO_2$ | 0.5<br>5.0 | 70 | 71 | 20 | −7.9 | −7.7 | −3.2 |
| 700 | 2 | 0.5 | 0.5 | 0.5 | $Sb_2O_3$<br>$SnO_2$ | 0.01<br>0.5 | 90 | 70 | 22 | −8.3 | −7.3 | −3.2 |
| 700 | 2 | 0.5 | 0.5 | 0.5 | $Sb_2O_3$<br>$SnO_2$ | 8.0<br>0.5 | 72 | 70 | 20 | −8.2 | −7.4 | −3.3 |
| 500 | 10 | 0.5 | 0.5 | 0.5 | $Sb_2O_3$<br>$SnO_2$ | 1.0<br>0.5 | 60 | 71 | 23 | −7.6 | −8.0 | −2.5 |
| 700 | 2 | 0.5 | 0.5 | 0.5 | $Sb_2O_3$<br>$SnO_2$ | 1.0<br>0.5 | 55 | 80 | 26 | −5.2 | −5.1 | −1.6 |
| 800 | 2 | 0.5 | 0.5 | 0.5 | $Sb_2O_3$<br>$SnO_2$ | 1.0<br>0.5 | 54 | 80 | 27 | −5.4 | −5.2 | −1.8 |
| 1000 | 1 | 0.5 | 0.5 | 0.5 | $Sb_2O_3$<br>$SnO_2$ | 1.0<br>0.5 | 65 | 74 | 24 | −7.6 | −6.8 | −2.3 |
| 500 | 10 | 0.5 | 0.5 | 0.5 | $Sb_2O_3$<br>$Cr_2O_3$ | 1.0<br>0.5 | 75 | 70 | 21 | −7.3 | −8.2 | −2.7 |
| 700 | 2 | 0.5 | 0.5 | 0.5 | $Sb_2O_3$<br>$Cr_2O_3$ | 1.0<br>0.5 | 50 | 79 | 26 | −6.0 | −5.7 | −1.5 |
| 800 | 2 | 0.5 | 0.5 | 0.5 | $Sb_2O_3$<br>$Cr_2O_3$ | 1.0<br>0.5 | 48 | 78 | 26 | −6.1 | −5.3 | −1.7 |
| 1000 | 5 | 0.5 | 0.5 | 0.5 | $Sb_2O_3$<br>$Cr_2O_3$ | 1.0<br>0.5 | 70 | 71 | 23 | −7.8 | −7.8 | −2.8 |
| 500 | 10 | 0.5 | 0.5 | 0.5 | $Sb_2O_3$<br>$SiO_2$ | 1.0<br>0.5 | 73 | 71 | 22 | −8.0 | −8.6 | −3.0 |
| 700 | 2 | 0.5 | 0.5 | 0.5 | $Sb_2O_3$<br>$SiO_2$ | 1.0<br>0.5 | 48 | 80 | 26 | −5.0 | −5.9 | −1.7 |
| 800 | 2 | 0.5 | 0.5 | 0.5 | $Sb_2O_3$<br>$SiO_2$ | 1.0<br>0.5 | 46 | 79 | 25 | −5.4 | −5.4 | −1.7 |
| 1000 | 1 | 0.5 | 0.5 | 0.5 | $Sb_2O_3$<br>$SiO_2$ | 1.0<br>0.5 | 68 | 72 | 22 | −7.9 | −8.3 | −2.9 |
| 500 | 10 | 0.5 | 0.5 | 0.5 | $Sb_2O_3$<br>NiO | 1.0<br>0.5 | 68 | 70 | 22 | −8.0 | −7.8 | −3.0 |
| 700 | 2 | 0.5 | 0.5 | 0.5 | $Sb_2O_3$<br>NiO | 1.0<br>0.5 | 43 | 79 | 27 | −5.1 | −5.2 | −1.5 |
| 800 | 2 | 0.50 | 0.5 | 0.5 | $Sb_2O_3$<br>NiO | 1.0<br>0.5 | 41 | 77 | 28 | −5.0 | −5.0 | −1.4 |
| 1000 | 1 | 0.5 | 0.5 | 0.5 | $Sb_2O_3$<br>NiO | 1.0<br>0.5 | 64 | 70 | 23 | −7.6 | −8.3 | −2.9 |
| 500 | 10 | 0.5 | 0.5 | 0.5 | $Cr_2O_3$<br>$SiO_2$ | 0.5<br>0.5 | 95 | 75 | 25 | −8.8 | −8.4 | −5.1 |
| 700 | 2 | 0.5 | 0.5 | 0.5 | $Cr_2O_3$<br>SiO | 0.5<br>0.5 | 72 | 80 | 29 | −5.1 | −5.4 | −1.4 |
| 800 | 2 | 0.5 | 0.5 | 0.5 | $Cr_2O_3$<br>$SiO_2$ | 0.5<br>0.5 | 70 | 81 | 27 | −5.1 | −5.1 | −1.3 |

Table 4-continued

| Heat-treating of zinc oxide powder | | Additives (mole %) | | | | | Electrical characteristics of Resultant Resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C (at a given current of 1mA) (V) | $n_1$ | $n_2$ | ΔC (at a given current of 1mA) | $\Delta n_1$ | $\Delta n_2$ |
| 1000 | 1 | 0.5 | 0.5 | 0.5 | $Cr_2O_3$ | 0.5 | 89 | 74 | 24 | −6.6 | −8.5 | −3.0 |
| | | | | | $SiO_2$ | 0.5 | | | | | | |
| 500 | 10 | 0.5 | 0.5 | 0.5 | $SnO_2$ | 0.5 | 70 | 72 | 25 | −6.6 | −6.5 | −2.9 |
| | | | | | $Cr_2O_3$ | 0.5 | | | | | | |
| 700 | 2 | 0.5 | 0.5 | 0.5 | $SnO_2$ | 0.5 | 65 | 82 | 30 | −;5.0 | −5.2 | −1.8 |
| | | | | | $Cr_2O_3$ | 0.5 | | | | | | |
| 800 | 2 | 0.5 | 0.5 | 0.5 | $SnO_2$ | 0.5 | 64 | 81 | 30 | −5.1 | −4.7 | −1.7 |
| | | | | | $Cr_2O_3$ | 0.5 | | | | | | |
| 1000 | 1 | 0.5 | 0.5 | 0.5 | $SiO_2$ | 0.5 | 75 | 73 | 20 | −6.5 | −6.0 | −3.1 |
| | | | | | NiO | 0.5 | | | | | | |
| 500 | 10 | 0.5 | 0.5 | 0.5 | $SiO_2$ | 0.5 | 70 | 70 | 20 | −6.3 | −6.5 | −2.9 |
| | | | | | NiO | 0.5 | | | | | | |
| 700 | 2 | 0.5 | 0.5 | 0.5 | $SiO_2$ | 0.5 | 63 | 75 | 27 | −5.0 | −5.1 | −1.4 |
| | | | | | NiO | 0.5 | | | | | | |
| 800 | 2 | 0.5 | 0.5 | 0.5 | $SiO_2$ | 0.5 | 60 | 74 | 28 | −4.9 | −4.8 | −1.7 |
| | | | | | NiO | 0.5 | | | | | | |
| 1000 | 1 | 0.5 | 0.5 | 0.5 | $SnO_2$ | 0.5 | 72 | 69 | 20 | −6.9 | −7.0 | −2.9 |
| | | | | | $SiO_2$ | 0.5 | | | | | | |
| 500 | 10 | 0.5 | 0.5 | 0.5 | $SnO_2$ | 0.5 | 95 | 75 | 25 | −7.3 | −8.1 | −2.7 |
| | | | | | $SiO_2$ | 0.5 | | | | | | |
| 700 | 2 | 0.5 | 0.5 | 0.5 | $SnO_2$ | 0.5 | 80 | 80 | 29 | −5.1 | −5.2 | −1.4 |
| | | | | | $SiO_2$ | 0.5 | | | | | | |
| 800 | 2 | 0.5 | 0.5 | 0.5 | $SnO_2$ | 0.5 | 81 | 81 | 29 | −5.2 | −5.0 | −1.3 |
| | | | | | $SiO_2$ | 0.5 | | | | | | |
| 1000 | 1 | 0.5 | 0.5 | 0.5 | $SnO_2$ | 0.5 | 100 | 70 | 24 | −6.8 | −7.5 | −2.3 |
| | | | | | NiO | 0.5 | | | | | | |
| 500 | 10 | 0.5 | 0.5 | 0.5 | $SnO_2$ | 0.5 | 60 | 50 | 25 | −6.7 | −7.4 | −2.4 |
| | | | | | NiO | 0.5 | | | | | | |
| 700 | 2 | 0.5 | 0.5 | 0.5 | $SnO_2$ | 0.5 | 32 | 62 | 30 | −5.5 | −5.8 | −1.7 |
| | | | | | NiO | 0.5 | | | | | | |
| 800 | 2 | 0.5 | 0.5 | 0.5 | $SnO_2$ | 0.5 | 30 | 60 | 30 | −7.1 | −5.5 | −1.6 |
| | | | | | NiO | 0.5 | | | | | | |
| 1000 | 1 | 0.5 | 0.5 | 0.5 | $SnO_2$ | 0.5 | 70 | 49 | 24 | −6.9 | −8.0 | −2.4 |
| | | | | | NiO | 0.5 | | | | | | |
| 500 | 10 | 0.5 | 0.5 | 0.5 | $Sb_2O_3$ | 1.0 | 120 | 71 | 25 | −4.8 | −2.1 | −2.0 |
| | | | | | $SnO_2$ | 0.5 | | | | | | |
| | | | | | $Cr_2O_3$ | 0.5 | | | | | | |
| 700 | 2 | 0.5 | 0.5 | 0.5 | $Sb_2O_3$ | 1.0 | 105 | 80 | 31 | −2.3 | −0.6 | −0.8 |
| | | | | | $SnO_2$ | 0.5 | | | | | | |
| | | | | | $Cr_2O_3$ | 0.5 | | | | | | |
| 800 | 2 | 0.5 | 0.5 | 0.5 | $Sb_2O_3$ | 1.0 | 100 | 80 | 31 | −2.2 | −0.7 | −0.7 |
| | | | | | $SnO_2$ | 0.5 | | | | | | |
| | | | | | $Cr_2O_3$ | 0.5 | | | | | | |
| 1000 | 1 | 0.5 | 0.5 | 0.5 | $Sb_2O_3$ | 1.0 | 140 | 70 | 27 | − 4.3 | −2.1 | −2.0 |
| | | | | | SnO | 0.5 | | | | | | |
| | | | | | $Cr_2O_3$ | 0.5 | | | | | | |
| 500 | 10 | 0.5 | 0.5 | 0.5 | $Sb_2O_3$ | 1.0 | 125 | 72 | 25 | −4.5 | −2.0 | −1.7 |
| | | | | | $SnO_2$ | 0.5 | | | | | | |
| | | | | | $SiO_2$ | 0.5 | | | | | | |
| 700 | 2 | 0.5 | 0.5 | 0.5 | $Sb_2O_3$ | 1.0 | 100 | 79 | 28 | −2.0 | −0.8 | −0.6 |
| | | | | | $SnO_2$ | 0.5 | | | | | | |
| | | | | | $SiO_2$ | 0.5 | | | | | | |
| 800 | 2 | 0.5 | 0.5 | 0.5 | $Sb_2O_3$ | 1.0 | 95 | 80 | 28 | −2.3 | −0.6 | −0.7 |
| | | | | | $SnO_2$ | 0.5 | | | | | | |
| | | | | | $SiO_2$ | 0.5 | | | | | | |
| 1000 | 1 | 0.5 | 0.5 | 0.5 | $Sb_2O_3$ | 1.0 | 130 | 73 | 24 | −4.0 | −2.1 | −1.5 |
| | | | | | $SnO_2$ | 0.5 | | | | | | |
| | | | | | $SiO_2$ | 0.5 | | | | | | |
| 500 | 10 | 0.5 | 0.5 | 0.5 | $Sb_2O_3$ | 1.0 | 210 | 70 | 25 | −3.9 | −2.4 | −1.6 |
| | | | | | $SnO_2$ | 0.5 | | | | | | |
| | | | | | NiO | 0.5 | | | | | | |
| 700 | 2 | 0.5 | 0.5 | 0.5 | $Sb_2O_3$ | 1.0 | 170 | 82 | 32 | −2.7 | −1.1 | −0.8 |
| | | | | | $SnO_2$ | 0.5 | | | | | | |
| | | | | | NiO | 0.5 | | | | | | |
| 800 | 2 | 0.5 | 0.5 | 0.5 | $Sb_2O_3$ | 1.0 | 165 | 81 | 30 | −2.3 | −1.2 | −1.1 |
| | | | | | $SnO_2$ | 0.5 | | | | | | |
| | | | | | NiO | 0.5 | | | | | | |

Table 4-continued

| Heat-treating of zinc oxide powder | | Additives (mole %) | | | | | Electrical characteristics of Resultant Resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C (at a given current of 1mA) (V) | $n_1$ | $n_2$ | ΔC (at a given current of 1mA) | $\Delta n_1$ | $\Delta n_2$ |
| 1000 | 1 | 0.5 | 0.5 | 0.5 | $Sb_2O_3$<br>$SnO_2$<br>NiO | 1.0<br>0.5<br>0.5 | 250 | 65 | 24 | −4.0 | −2.3 | −1.6 |
| 500 | 10 | 0.5 | 0.5 | 0.5 | $SnO_2$<br>$SiO_2$<br>NiO | 0.5<br>0.5<br>0.5 | 230 | 69 | 24 | −4.2 | −3.1 | −2.1 |
| 700 | 2 | 0.5 | 0.5 | 0.5 | $SnO_2$<br>$SiO_2$<br>NiO | 0.5<br>0.5<br>0.5 | 140 | 75 | 30 | −2.5 | −1.4 | −0.7 |
| 800 | 2 | 0.5 | 0.5 | 0.5 | $SnO_2$<br>$SiO_2$<br>NiO | 0.5<br>0.5<br>0.5 | 160 | 76 | 31 | −2.3 | −1.6 | −0.8 |
| 1000 | 1 | 0.5 | 0.5 | 0.5 | $SnO_2$<br>$SiO_2$<br>NiO | 0.5<br>0.5<br>0.5 | 200 | 67 | 25 | −4.3 | −3.0 | −2.1 |
| 500 | 10 | 0.5 | 0.5 | 0.5 | $SiO_2$<br>NiO<br>$Cr_2O_3$ | 0.5<br>0.5<br>0.5 | 250 | 70 | 25 | −4.1 | −0.8 | −1.8 |
| 700 | 2 | 0.5 | 0.5 | 0.5 | $SiO_2$<br>NiO<br>$Cr_2O_3$ | 0.5<br>0.5<br>0.5 | 230 | 78 | 30 | −2.0 | −1.7 | −1.0 |
| 800 | 2 | 0.5 | 0.5 | 0.5 | $SiO_2$<br>NiO<br>$Cr_2O_3$ | 0.5<br>0.5<br>0.5 | 220 | 78 | 31 | −2.3 | −1.4 | −0.8 |
| 1000 | 1 | 0.5 | 0.5 | 0.5 | $SiO_2$<br>NiO<br>$Cr_2O_3$ | 0.5<br>0.5<br>0.5 | 260 | 71 | 24 | −4.3 | −0.9 | −2.1 |
| 500 | 10 | 0.5 | 0.5 | 0.5 | $Sb_2O_3$<br>NiO<br>$Cr_2O_3$ | 1.0<br>0.5<br>0.5 | 180 | 72 | 22 | −3.2 | −3.1 | −2.5 |
| 700 | 2 | 0.5 | 0.5 | 0.5 | $Sb_2O_3$<br>NiO<br>$Cr_2O_3$ | 1.0<br>0.5<br>0.5 | 150 | 80 | 28 | −0.9 | −1.3 | −0.2 |
| 800 | 2 | 0.5 | 0.5 | 0.5 | $Sb_2O_3$<br>NiO<br>$Cr_2O_3$ | 1.0<br>0.5<br>0.5 | 140 | 81 | 30 | −2.6 | −0.8 | −0.9 |
| 1000 | 1 | 0.5 | 0.5 | 0.5 | $Sb_2O_3$<br>NiO<br>$Cr_2O_3$ | 1.0<br>0.5<br>0.5 | 190 | 73 | 21 | −4.1 | −2.3 | −1.5 |
| 500 | 10 | 0.5 | 0.5 | 0.5 | $SnO_2$<br>NiO<br>$Cr_2O_3$ | 0.5<br>0.5<br>0.5 | 70 | 70 | 25 | −4.4 | −2.5 | −1.7 |
| 700 | 2 | 0.5 | 0.5 | 0.5 | $SnO_2$<br>NiO<br>$Cr_2O_3$ | 0.5<br>0.5<br>0.5 | 50 | 81 | 31 | −2.6 | −1.3 | −0.8 |
| 800 | 2 | 0.5 | 0.5 | 0.5 | $SnO_2$<br>NiO<br>$Cr_2O_3$ | 0.5<br>0.5<br>0.5 | 48 | 80 | 32 | −2.5 | −1.1 | −0.7 |
| 1000 | 1 | 0.5 | 0.5 | 0.5 | $SnO_2$<br>NiO<br>$Cr_2O_3$ | 0.5<br>0.5<br>0.5 | 70 | 73 | 26 | −4.2 | −2.5 | −1.8 |
| 500 | 10 | 0.5 | 0.5 | 0.5 | $Sb_2O_3$<br>NiO<br>$SiO_2$ | 1.0<br>0.5<br>0.5 | 105 | 65 | 25 | −4.4 | −3.3 | −1.9 |
| 700 | 2 | 0.5 | 0.5 | 0.5 | $Sb_2O_3$<br>NiO<br>$SiO_2$ | 1.0<br>0.5<br>0.5 | 72 | 79 | 31 | −2.4 | −1.3 | −0.9 |
| 800 | 2 | 0.5 | 0.5 | 0.5 | $Sb_2O_3$<br>NiO<br>$SiO_2$ | 1.0<br>0.5<br>0.5 | 70 | 75 | 32 | −2.2 | −1.5 | −1.0 |
| 1000 | 1 | 0.5 | 0.5 | 0.5 | $Sb_2O_3$<br>NiO<br>$SiO_2$ | 1.0<br>0.5<br>0.5 | 95 | 62 | 26 | −4.6 | −3.1 | −2.2 |
| 500 | 10 | 0.5 | 0.5 | 0.5 | $Sb_2O_3$<br>$SiO_2$<br>$Cr_2O_3$ | 1.0<br>0.5<br>0.5 | 130 | 70 | 25 | −4.6 | −3.8 | −2.1 |
| 700 | 2 | 0.5 | 0.5 | 0.5 | $Sb_2O_3$<br>$SiO_2$ 0.5<br>$Cr_2O_3$ | 1.0<br>100<br>0.5 | 79 | 32 | −2.3 | −0.9 | −1.0 | |
| 800 | 2 | 0.5 | 0.5 | 0.5 | $Sb_2O_3$<br>$SiO_2$<br>$Cr_2O_3$ | 1.0<br>0.5<br>0.5 | 95 | 78 | 33 | −2.1 | −1.0 | −0.8 |
| 1000 | 1 | 0.5 | 0.5 | 0.5 | $Sb_2O_3$<br>$SiO_2$<br>$Cr_2O_3$ | 1.0<br>0.5<br>0.5 | 140 | 69 | 26 | −4.7 | −2.9 | −2.3 |
| 500 | 10 | 0.5 | 0.5 | 0.5 | $SnO_2$<br>NiO<br>$Cr_2O_3$ | 0.5<br>0.5<br>0.5 | 80 | 70 | 27 | −3.5 | −3.8 | −2.5 |
| 700 | 2 | 0.5 | 0.5 | 0.5 | $SnO_2$<br>NiO<br>$Cr_2O_3$ | 0.5<br>0.5<br>0.5 | 62 | 78 | 32 | −0.9 | −1.1 | −0.4 |
| 800 | 2 | 0.5 | 0.5 | 0.5 | $SnO_2$<br>NiO<br>$Cr_2O_3$ | 0.5<br>0.5<br>0.5 | 65 | 79 | 33 | −2.2 | −0.4 | −0.9 |

Table 4-continued

| Heat-treating of zinc oxide powder | | Additives (mole %) | | | | | Electrical characteristics of Resultant Resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C (at a given current of 1mA) (V) | $n_1$ | $n_2$ | ΔC (at a given current of 1mA) | $\Delta n_1$ | $\Delta n_2$ |
| 1000 | 1 | 0.5 | 0.5 | 0.5 | $SnO_2$ | 0.5 | 83 | 72 | 28 | −4.3 | −1.1 | −1.4 |
| | | | | | NiO | 0.5 | | | | | | |
| | | | | | $Cr_2O_3$ | 0.5 | | | | | | |
| 500 | 10 | 0.5 | 0.5 | 0.5 | $Sb_2O_3$ | 1.0 | 75 | 80 | 31 | −2.1 | +0.1 | +0.2 |
| | | | | | $SnO_2$ | 0.5 | | | | | | |
| | | | | | NiO | 0.5 | | | | | | |
| | | | | | $Cr_2O_3$ | 0.5 | | | | | | |
| 700 | 2 | 0.5 | 0.5 | 0.5 | $Sb_2O_3$ | 1.0 | 60 | 85 | 35 | −1.5 | +1.8 | +2.0 |
| | | | | | $SnO_2$ | 0.5 | | | | | | |
| | | | | | NiO | 0.5 | | | | | | |
| | | | | | $Cr_2O_3$ | 0.5 | | | | | | |
| 800 | 2 | 0.5 | 0.5 | 0.5 | $Sb_2O_3$ | 1.0 | 58 | 86 | 36 | −1.3 | +1.7 | +2.0 |
| | | | | | $SnO_2$ | 0.5 | | | | | | |
| | | | | | NiO | 0.5 | | | | | | |
| | | | | | $Cr_2O_3$ | 0.5 | | | | | | |
| 1000 | 1 | 0.5 | 0.5 | 0.5 | $Sb_2O_3$ | 1.0 | 80 | 79 | 30 | −2.1 | +0.2 | +0.5 |
| | | | | | $SnO_2$ | 0.5 | | | | | | |
| | | | | | NiO | 0.5 | | | | | | |
| | | | | | $Cr_2O_3$ | 0.5 | | | | | | |
| 500 | 10 | 0.5 | 0.5 | 0.5 | $Sb_2O_3$ | 1.0 | 80 | 80 | 30 | −1.0 | +0.5 | +0.2 |
| | | | | | NiO | 0.5 | | | | | | |
| | | | | | $Cr_2O_3$ | 0.5 | | | | | | |
| | | | | | $SiO_2$ | 0.5 | | | | | | |
| 700 | 2 | 0.5 | 0.5 | 0.5 | $Sb_2O_3$ | 1.0 | 62 | 87 | 37 | −0.5 | +1.3 | +1.3 |
| | | | | | NiO | 0.5 | | | | | | |
| | | | | | $Cr_2O_3$ | 0.5 | | | | | | |
| | | | | | $SiO_2$ | 0.5 | | | | | | |
| 800 | 2 | 0.5 | 0.5 | 0.5 | $Sb_2O_3$ | 1.0 | 60 | 88 | 38 | −0.1 | +1.5 | +1.4 |
| | | | | | NiO | 0.5 | | | | | | |
| | | | | | $Cr_2O_3$ | 0.5 | | | | | | |
| | | | | | $SiO_2$ | 0.5 | | | | | | |
| 1000 | 1 | 0.5 | 0.5 | 0.5 | $Sb_2O_3$ | 1.0 | 85 | 84 | 31 | −1.3 | +0.3 | +0.5 |
| | | | | | NiO | 0.5 | | | | | | |
| | | | | | $Cr_2O_3$ | 0.5 | | | | | | |
| | | | | | $SiO_2$ | 0.5 | | | | | | |
| 500 | 10 | 0.5 | 0.5 | 0.5 | $Sb_2O_3$ | 1.0 | 105 | 80 | 29 | −2.5 | +0.4 | +0.4 |
| | | | | | $SnO_2$ | 0.5 | | | | | | |
| | | | | | NiO | 0.5 | | | | | | |
| | | | | | $SiO_2$ | 0.5 | | | | | | |
| 700 | 2 | 0.5 | 0.5 | 0.5 | $Sb_2O_3$ | 1.0 | 62 | 89 | 40 | −0.9 | +1.3 | +1.4 |
| | | | | | $SnO_2$ | 0.5 | | | | | | |
| | | | | | NiO | 0.5 | | | | | | |
| | | | | | $SiO_2$ | 0.5 | | | | | | |
| 800 | 2 | 0.5 | 0.5 | 0.5 | $Sb_2O_3$ | 1.0 | 60 | 90 | 41 | −0.7 | +1.4 | +1.8 |
| | | | | | $SnO_2$ | 0.5 | | | | | | |
| | | | | | NiO | 0.5 | | | | | | |
| | | | | | $SiO_2$ | 0.5 | | | | | | |
| 1000 | 1 | 0.5 | 0.5 | 0.5 | $Sb_2O_3$ | 1.0 | 95 | 81 | 33 | −1.9 | +0.6 | +0.2 |
| | | | | | $SnO_2$ | 0.5 | | | | | | |
| | | | | | NiO | 0.5 | | | | | | |
| | | | | | $SiO_2$ | 0.5 | | | | | | |
| 500 | 10 | 0.5 | 0.5 | 0.5 | $Sb_2O_3$ | 1.0 | 100 | 80 | 30 | −1.9 | +0.9 | +0.3 |
| | | | | | $SnO_2$ | 0.5 | | | | | | |
| | | | | | $Cr_2O_3$ | 0.5 | | | | | | |
| | | | | | $SiO_2$ | 0.5 | | | | | | |
| 700 | 2 | 0.5 | 0.5 | 0.5 | $Sb_2O_3$ | 1.0 | 60 | 88 | 38 | −1.0 | +3.8 | +1.8 |
| | | | | | $SnO_2$ | 0.5 | | | | | | |
| | | | | | $Cr_2O_3$ | 0.5 | | | | | | |
| | | | | | $SiO_2$ | 0.5 | | | | | | |
| 800 | 2 | 0.5 | 0.5 | 0.5 | $Sb_2O_3$ | 1.0 | 70 | 90 | 39 | −1.1 | +3.7 | +1.7 |
| | | | | | $SnO_2$ | 0.5 | | | | | | |
| | | | | | $Cr_2O_3$ | 0.5 | | | | | | |
| | | | | | $SiO_2$ | 0.5 | | | | | | |
| 1000 | 1 | 0.5 | 0.5 | 0.5 | $Sb_2O_3$ | 1.0 | 95 | 81 | 32 | −1.8 | +1.0 | +0.5 |
| | | | | | $SnO_2$ | 0.5 | | | | | | |
| | | | | | $Cr_2O_3$ | 0.5 | | | | | | |
| | | | | | $SiO_2$ | 0.5 | | | | | | |
| 500 | 10 | 0.5 | 0.5 | 0.5 | $SnO_2$ | 0.5 | 50 | 70 | 30 | −1.6 | +2.5 | +0.1 |
| | | | | | NiO | 0.5 | | | | | | |
| | | | | | $Cr_2O_3$ | 0.5 | | | | | | |
| | | | | | $SiO_2$ | 0.5 | | | | | | |

Table 4-continued

| Heat-treating of zinc oxide powder | | Additives (mole %) | | | | | Electrical characteristics of Resultant Resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C (at a given current of 1mA) (V) | $n_1$ | $n_2$ | ΔC (at a given current of 1mA) | $\Delta n_1$ | $\Delta n_2$ |
| 700 | 2 | 0.5 | 0.5 | 0.5 | $SnO_2$ | 0.5 | 33 | 78 | 35 | −1.0 | +4.3 | +1.9 |
| | | | | | NiO | 0.5 | | | | | | |
| | | | | | $Cr_2O_3$ | 0.5 | | | | | | |
| | | | | | $SiO_2$ | 0.5 | | | | | | |
| 800 | 2 | 0.5 | 0.5 | 0.5 | $SnO_2$ | 0.5 | 26 | 80 | 36 | −0.9 | +4.1 | +1.7 |
| | | | | | NiO | 0.5 | | | | | | |
| | | | | | $Cr_2O_3$ | 0.5 | | | | | | |
| | | | | | $SiO_2$ | 0.5 | | | | | | |
| 1000 | 1 | 0.5 | .5 | 0.5 | $SnO_2$ | 0.5 | 60 | 72 | 31 | −1.9 | +0.3 | +0.4 |
| | | | | | NiO | 0.5 | | | | | | |
| | | | | | $Cr_2O_3$ | 0.5 | | | | | | |
| | | | | | $SiO_2$ | 0.5 | | | | | | |
| 500 | 10 | 0.5 | 0.5 | 0.5 | $Sb_2O_3$ | 1.0 | 70 | 80 | 32 | −0.7 | +2.6 | +2.3 |
| | | | | | $SnO_2$ | 0.5 | | | | | | |
| | | | | | NiO | 0.5 | | | | | | |
| | | | | | $Cr_2O_3$ | 0.5 | | | | | | |
| | | | | | $SiO_2$ | 0.5 | | | | | | |
| 700 | 2 | 0.5 | 0.5 | 0.5 | $Sb_2O_3$ | 1.0 | 62 | 89 | 40 | −0.6 | +2.9 | +3.4 |
| | | | | | $SnO_2$ | 0.5 | | | | | | |
| | | | | | NiO | 0.5 | | | | | | |
| | | | | | $Cr_2O_3$ | 0.5 | | | | | | |
| | | | | | $SiO_2$ | 0.5 | | | | | | |
| 800 | 2 | 0.5 | 0.5 | 0.5 | $Sb_2O_3$ | 1.0 | 60 | 90 | 41 | −0.2 | +7.2 | +6.2 |
| | | | | | $SnO_2$ | 0.5 | | | | | | |
| | | | | | NiO | 0.5 | | | | | | |
| | | | | | $Cr_2O_3$ | 0.5 | | | | | | |
| | | | | | $SiO_3$ | 0.5 | | | | | | |
| 1000 | 1 | 0.5 | 0.5 | 0.5 | $Sb_2O_3$ | 1.0 | 69 | 81 | 33 | −0.1 | +2.0 | +1.0 |
| | | | | | $SnO_2$ | 0.5 | | | | | | |
| | | | | | NiO | 0.5 | | | | | | |
| | | | | | $Cr_2O_3$ | 0.5 | | | | | | |
| | | | | | $SiO_2$ | 0.5 | | | | | | |

EXAMPLE 5

Zinc oxide and additives of Table 5 were fabricated into voltage-dependent resistors by the same process as that of Example 4. The electrical characteristics of the resultant resistors are shown in Table 5. It will be easily understood that the heat-treating of zinc oxide powder results in the higher n-value, smaller change rate and lower C-value without reducing the n-value. The preferred results can be obtained when the heat-treating temperature of the zinc oxide powder is between 700°C and 800°C.

Table 5

| Heat-treating of zinc oxide powder | | Additives (mole %) | | | | | Electrical characteristics of Resultant resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C(at a given Current of 1mA) (V) | $n_1$ | $n_2$ | ΔC(at a given current of 1mA) | $\Delta n_1$ | $\Delta n_2$ |
| 700 | 2 | 0.01 | 0.1 | 0.1 | $TiO_2$ | 0.1 | 15 | 45 | 20 | −9.2 | −10 | −5.2 |
| 700 | 2 | 0.01 | 0.1 | 0.1 | $TiO_2$ | 3.0 | 13 | 45 | 21 | −9.1 | −8.1 | −4.8 |
| 700 | 2 | 0.01 | 3.0 | 0.1 | $TiO_2$ | 0.1 | 15 | 42 | 20 | −8.5 | −9.3 | −4.6 |
| 700 | 2 | 0.01 | 0.1 | 3.0 | $TiO_2$ | 0.6 | 14 | 45 | 22 | −9.3 | −10 | −4.7 |
| 700 | 2 | 0.01 | 3.0 | 3.0 | $TiO_2$ | 0.1 | 15 | 45 | 21 | −8.5 | −9.5 | −4.8 |
| 700 | 2 | 0.01 | 0.1 | 3.0 | $TiO_2$ | 3.0 | 12 | 46 | 20 | −8.6 | −10 | −4.6 |
| 700 | 2 | 0.01 | 3.0 | 0.1 | $TiO_2$ | 3.0 | 14 | 45 | 20 | −9.1 | −8.2 | −4.6 |
| 700 | 2 | 10.0 | 3.0 | 0.1 | $TiO_2$ | 0.1 | 10 | 43 | 21 | −9.3 | −8.1 | −4.7 |
| 700 | 2 | 10.0 | 0.1 | 3.0 | $TiO_2$ | 0.1 | 9 | 43 | 20 | −8.7 | −10 | −4.7 |
| 700 | 2 | 10.0 | 0.1 | 0.1 | $TiO_2$ | 3.0 | 5 | 42 | 20 | −8.1 | −9.5 | −5.0 |
| 700 | 2 | 0.01 | 3.0 | 3.0 | $TiO_2$ | 3.0 | 13 | 45 | 22 | −9.4 | −9.7 | −5.0 |
| 700 | 2 | 10.0 | 0.1 | 3.0 | $TiO_2$ | 3.0 | 10 | 44 | 22 | −9.8 | −8.3 | − 4.6 |
| 700 | 2 | 10.0 | 3.0 | 0.1 | $TiO_2$ | 3.0 | 4 | 40 | 20 | −9.9 | −9.6 | −4.3 |
| 700 | 2 | 10.0 | 3.0 | 3.0 | $TiO_2$ | 0.1 | 14 | 42 | 21 | −10 | −10 | −4.1 |
| 700 | 2 | 10.0 | 3.0 | 3.0 | $TiO_2$ | 3.0 | 15 | 41 | 21 | −10 | −10 | −3.8 |
| 500 | 10 | 0.5 | 0.5 | 0.5 | $TiO_2$ | 0.5 | 12 | 40 | 20 | −17.2 | −6.2 | −3.7 |
| 700 | 2 | 0.5 | 0.5 | 0.5 | $TiO_2$ | 0.5 | 8 | 43 | 24 | −6.1 | −5.1 | −3.9 |
| 800 | 2 | 0.5 | 0.5 | 0.5 | $TiO_2$ | 0.5 | 8 | 47 | 25 | −6.3 | −5.1 | −4.0 |
| 1000 | 1 | 0.5 | 0.5 | 0.5 | $TiO_2$ | 0.5 | 15 | 40 | 20 | −17.2 | −5.9 | −4.1 |
| 700 | 2 | 0.01 | 0.1 | 0.1 | BaO | 0.01 | 42 | 30 | 20 | −10 | −10 | −4.3 |
| 700 | 2 | 10.0 | 3.0 | 3.0 | BaO | 5.0 | 70 | 30 | 20 | −9.1 | −9.8 | −4.2 |
| 500 | 10 | 0.5 | 0.5 | 0.5 | BaO | 0.5 | 38 | 31 | 21 | −7.5 | −8.5 | −3.8 |
| 700 | 2 | 0.5 | 0.5 | 0.5 | BaO | 0.5 | 25 | 36 | 26 | −5.0 | −5.1 | −3.1 |
| 1000 | 1 | 0.5 | 0.5 | 0.5 | BaO | 0.5 | 40 | 30 | 21 | −8.2 | − 7.4 | −3.9 |
| 700 | 2 | 0.01 | 0.1 | 0.1 | $Cr_2O_3$ | 0.01 | 48 | 28 | 20 | − | | |

Table 5-continued

| Heat-treating of zinc oxide powder | | Additives (mole %) | | | | | Electrical characteristics of Resultant resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C(at a given Current of 1mA) (V) | $n_1$ | $n_2$ | ΔC(at a given current of 1mA) | $\Delta n_1$ | $\Delta n_2$ |
| 500 | −9.9 | −4.9 | | | | | | | | | | |
| 700 | 2 | 10.0 | 3.0 | 3.0 | $Cr_2O_3$ | 5.0 | 50 | 29 | 20 | −9.4 | −8.9 | −4.3 |
| 500 | 10 | 0.5 | 0.5 | 0.5 | $Cr_2O_3$ | 0.1 | 68 | 35 | 22 | −9.1 | −9.3 | −4.2 |
| 700 | 2 | 0.5 | 0.5 | 0.5 | $Cr_2O_3$ | 0.1 | 60 | 38 | 25 | −6.0 | −5.5 | −3.0 |
| 800 | 2 | 0.5 | 0.5 | 0.5 | $Cr_2O_3$ | 0.1 | 62 | 38 | 25 | −6.1 | −5.3 | −2.8 |
| 1000 | 1 | 0.50 | 0.5 | 0.5 | $Cr_2O_3$ | 0.1 | 70 | 35 | 23 | −9.8 | −8.7 | −4.0 |
| 700 | 2 | 0.01 | 0.1 | 0.1 | NiO | 0.01 | 68 | 38 | 20 | −8.5 | −9.5 | −3.8 |
| 700 | 2 | 10.0 | 3.0 | 3.0 | NiO | 5.0 | 52 | 35 | 21 | −8.3 | −9.1 | −4.2 |
| 500 | 10 | 0.5 | 0.5 | 0.5 | NiO | 0.5 | 35 | 40 | 23 | −9.2 | −9.0 | −4.1 |
| 700 | 2 | 0.5 | 0.5 | 0.5 | NiO | 0.5 | 22 | 42 | 26 | −5.1 | −5.0 | −2.8 |
| 800 | 2 | 0.5 | 0.5 | 0.5 | NiO | 0.5 | 20 | 42 | 26 | −5.5 | −4.9 | −2.5 |
| 1000 | 1 | 0.5 | 0.5 | 0.5 | NiO | 0.5 | 21 | 40 | 24 | −8.7 | −8.1 | −3.9 |
| 700 | 2 | 0.01 | 0.1 | 0.1 | $B_2O_3$ | 0.01 | 70 | 32 | 20 | −8.5 | −9.5 | −4.3 |
| 700 | 2 | 10.0 | 3.0 | 3.0 | $B_2O_3$ | 10.0 | 55 | 31 | 20 | −8.1 | −9.1 | −4.1 |
| 500 | 10 | 0.5 | 0.5 | 0.5 | $B_2O_3$ | 0.5 | 68 | 32 | 21 | −7.5 | −8.1 | −3.7 |
| 700 | 2 | 0.5 | 0.5 | 0.5 | $B_2O_3$ | 0.5 | 50 | 35 | 25 | −5.1 | −5.9 | −2.1 |
| 800 | 2 | 0.5 | 0.5 | 0.5 | $B_2O_3$ | 0.5 | 52 | 36 | 25 | −5.3 | −5.7 | −2.0 |
| 1000 | 1 | 0.5 | 0.5 | 0.5 | $B_2O_3$ | 0.5 | 70 | 30 | 22 | −9.1 | −8.1 | −3.8 |
| 700 | 2 | 0.5 | 0.5 | 0.5 | $TiO_2$<br>BaO | 0.01<br>0.01 | 75 | 35 | 17 | −7.5 | −8.1 | −3.2 |
| 700 | 2 | 0.5 | 0.5 | 0.5 | $TiO_2$<br>BaO | 1.0<br>0.5 | 20 | 40 | 20 | −7.2 | −7.9 | −3.0 |
| 700 | 2 | 0.5 | 0.5 | 0.5 | $TiO_2$<br>BaO | 0.5<br>5.0 | 32 | 40 | 20 | −7.8 | −7.6 | −3.2 |
| 700 | 2 | 0.5 | 0.5 | 0.5 | $TiO_2$<br>BaO | 0.1<br>0.5 | 30 | 40 | 20 | −8.2 | −7.2 | −3.1 |
| 700 | 2 | 0.5 | 0.5 | 0.5 | $TiO_2$<br>BaO | 3.0<br>0.5 | 30 | 40 | 19 | −8.3 | −7.5 | −3.2 |
| 500 | 10 | 0.5 | 0.5 | 0.5 | $TiO_2$<br>BaO | 0.5<br>0.5 | 25 | 45 | 22 | −7.5 | −8.1 | −2.6 |
| 700 | 2 | 0.5 | 0.5 | 0.5 | $TiO_2$<br>BaO | 0.5<br>0.5 | 15 | 50 | 25 | −5.1 | −5.3 | −1.7 |
| 800 | 2 | 0.5 | 0.5 | 0.5 | $TiO_2$<br>BaO | 0.5<br>0.5 | 16 | 50 | 24 | −5.5 | −5.4 | −1.8 |
| 1000 | 1 | 0.5 | 0.5 | 0.5 | $TiO_2$<br>BaO | 0.5<br>0.5 | 28 | 44 | 23 | −7.5 | −6.9 | −2.3 |
| 500 | 10 | 0.5 | 0.5 | 0.5 | $TiO_2$<br>$Cr_2O_3$ | 0.5<br>0.5 | 30 | 50 | 25 | −7.2 | −8.1 | −2.7 |
| 700 | 2 | 0.5 | 0.5 | 0.5 | $TiO_2$<br>$Cr_2O_3$ | 0.5<br>0.5 | 12 | 60 | 30 | −6.0 | −5.9 | −1.6 |
| 800 | 2 | 0.5 | 0.5 | 0.5 | $TiO_2$<br>$Cr_2O_3$ | 0.5<br>0.5 | 10 | 60 | 30 | −6.1 | −5.4 | −1.7 |
| 1000 | 5 | 0.5 | 0.5 | 0.5 | $TiO_2$<br>$Cr_2O_3$ | 0.5<br>0.5 | 28 | 50 | 25 | −7.8 | −7.9 | −2.8 |
| 500 | 10 | 0.5 | 0.5 | 0.5 | $TiO_2$<br>$BaO_3$ | 0.5<br>0.5 | 25 | 40 | 20 | −8.1 | −8.5 | −2.9 |
| 700 | 2 | 0.5 | 0.5 | 0.5 | $TiO_2$<br>$B_2O_3$ | 0.5<br>0.5 | 13 | 45 | 25 | −5.1 | −5.8 | −1.7 |
| 800 | 2 | 0.5 | 0.5 | 0.5 | $TiO_2$<br>$B_2O_3$ | 0.5<br>0.5 | 14 | 46 | 25 | −5.4 | −5.2 | −1.8 |
| 1000 | 1 | 0.5 | 0.5 | 0.5 | $TiO_2$<br>$B_2O_3$ | 0.5<br>0.5 | 30 | 41 | 21 | −7.9 | −8.1 | −2.8 |
| 500 | 10 | 0.5 | 0.5 | 0.5 | $TiO_2$<br>NiO | 0.5<br>0.5 | 43 | 35 | 18 | −8.1 | −7.9 | −3.0 |
| 700 | 2 | 0.5 | 0.5 | 0.5 | $TiO_2$<br>NiO | 0.5<br>0.5 | 15 | 40 | 20 | −5.3 | −5.1 | −1.6 |
| 800 | 2 | 0.5 | 0.5 | 0.5 | $TiO_2$<br>NiO | 0.5<br>0.5 | 20 | 41 | 21 | −5.2 | −5.0 | −1.6 |
| 1000 | 1 | 0.5 | 0.5 | 0.5 | $TiO_2$<br>NiO | 0.5<br>0.5 | 38 | 37 | 19 | −7.5 | −8.2 | −2.8 |
| 500 | 10 | 0.5 | 0.5 | 0.5 | $Cr_2O_3$<br>$B_2O_3$ | 0.5<br>0.5 | 68 | 38 | 19 | −8.7 | −8.3 | −3.1 |
| 700 | 2 | 0.5 | 0.5 | 0.5 | $Cr_2O_3$<br>$B_2O_3$ | 0.5<br>0.5 | 50 | 45 | 25 | −5.0 | −5.3 | −1.5 |
| 800 | 2 | 0.5 | 0.5 | 0.5 | $Cr_2O_3$<br>$B_2O_3$ | 0.5<br>0.5 | 48 | 46 | 26 | −5.1 | −5.0 | −1.3 |
| 1000 | 1 | 0.5 | 0.5 | 0.5 | $Cr_2O_3$<br>$B_2O_3$ | 0.5<br>0.5 | 65 | 40 | 20 | −6.5 | −8.4 | −3.0 |
| 500 | 10 | 0.5 | 0.5 | 0.5 | $Cr_2O_3$<br>NiO | 0.5<br>0.5 | 58 | 38 | 19 | −7.2 | −8.1 | −3.0 |
| 700 | 2 | 0.5 | 0.5 | 0.5 | $Cr_2O_3$<br>NiO | 0.5<br>0.5 | 38 | 42 | 21 | −5.5 | −5.7 | −1.7 |
| 800 | 2 | 0.5 | 0.5 | 0.5 | $Cr_2O_3$<br>NiO | 0.5<br>0.5 | 37 | 43 | 21 | −5.6 | −5.8 | −1.6 |
| 1000 | 1 | 0.5 | 0.5 | 0.5 | $Cr_2O_3$<br>NiO | 0.5<br>0.5 | 69 | 37 | 18 | −6.9 | −7.9 | −2.9 |
| 500 | 10 | 0.5 | 0.5 | 0.5 | BaO<br>$Cr_2O_3$ | 0.5<br>0.5 | 65 | 40 | 20 | −6.5 | −6.8 | −2.9 |
| 700 | 2 | 0.5 | 0.5 | 0.5 | BaO<br>$Cr_2O_3$ | 0.5<br>0.5 | 32 | 46 | 25 | −5.0 | −5.3 | −1.8 |
| 800 | 2 | 0.5 | 0.5 | 0.5 | BaO<br>$Cr_2O_3$ | 0.5<br>0.5 | 35 | 45 | 24 | −5.1 | −4.9 | −1.9 |
| 1000 | 1 | 0.5 | 0.5 | 0.5 | BaO<br>$Cr_2O_3$ | 0.5<br>0.5 | 55 | 39 | 21 | − 6.4 | −6.2 | −3.0 |
| 500 | 10 | 0.5 | 0.5 | 0.5 | $B_2O_3$<br>NiO | 0.5<br>0.5 | 55 | 33 | 20 | −6.2 | −6.9 | −2.8 |

Table 5-continued

| Heat-treating of zinc oxide powder | | Additives (mole %) | | | | | Electrical characteristics of Resultant resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C(at a given Current of 1mA) (V) | $n_1$ | $n_2$ | ΔC(at a given current of 1mA) | $\Delta n_1$ | $\Delta n_2$ |
| 700 | 2 | 0.5 | 0.5 | 0.5 | $B_2O_3$<br>NiO | 0.5<br>0.5 | 20 | 40 | 24 | −5.1 | −5.3 | −1.4 |
| 800 | 2 | 0.5 | 0.5 | 0.5 | $B_2O_3$<br>NiO | 0.5<br>0.5 | 21 | 40 | 24 | −5.0 | −5.1 | −1.7 |
| 1000 | 1 | 0.5 | 0.5 | 0.5 | $B_2O_3$<br>NiO | 0.5<br>0.5 | 62 | 35 | 21 | −6.8 | −7.2 | −2.9 |
| 500 | 10 | 0.5 | 0.5 | 0.5 | BaO<br>$B_2O_3$ | 0.5<br>0.5 | 80 | 38 | 19 | −7.2 | −8.0 | −2.6 |
| 700 | 2 | 0.5 | 0.5 | 0.5 | BaO<br>$B_2O_3$ | 0.5<br>0.5 | 65 | 42 | 21 | −5.0 | −5.1 | −1.5 |
| 800 | 2 | 0.5 | 0.5 | 0.5 | BaO<br>$B_2O_3$ | 0.5<br>0.5 | 60 | 43 | 22 | −4.9 | −4.8 | −1.4 |
| 1000 | 1 | 0.5 | 0.5 | 0.5 | BaO<br>$B_2O_3$ | 0.5<br>0.5 | 72 | 39 | 20 | −6.9 | −7.7 | −2.4 |
| 500 | 10 | 0.5 | 0.5 | 0.5 | BaO<br>NiO | 0.5<br>0.5 | 65 | 42 | 21 | −6.7 | −7.2 | −2.5 |
| 700 | 2 | 0.5 | 0.5 | 0.5 | BaO<br>NiO | 0.5<br>0.5 | 43 | 47 | 25 | −5.4 | −5.7 | −1.6 |
| 800 | 2 | 0.5 | 0.5 | 0.5 | BaO<br>NiO | 0.5<br>0.5 | 40 | 46 | 25 | −5.5 | −5.3 | −1.8 |
| 1000 | 1 | 0.5 | 0.5 | 0.5 | BaO<br>NiO | 0.5<br>0.5 | 59 | 41 | 20 | −6.9 | −7.8 | −2.3 |
| 500 | 10 | 0.5 | 0.5 | 0.5 | $TiO_2$<br>BaO<br>$Cr_2O_3$ | 0.5<br>0.5<br>0.5 | 42 | 42 | 21 | − 4.7 | −2.0 | −1.9 |
| 700 | 2 | 0.5 | 0.5 | 0.5 | $TiO_2$<br>BaO<br>$Cr_2O_3$ | 0.5<br>0.5<br>0.5 | 15 | 48 | 25 | −2.5 | −0.8 | −0.8 |
| 800 | 2 | 0.5 | 0.5 | 0.5 | $TiO_2$<br>BaO<br>$Cr_2O_3$ | 0.5<br>0.5<br>0.5 | 16 | 49 | 24 | −2.6 | −0.9 | −0.9 |
| 1000 | 1 | 0.5 | 0.5 | 0.5 | $TiO_2$<br>BaO<br>$Cr_2O_3$ | 0.5<br>0.5<br>0.5 | 29 | 41 | 20 | −4.5 | −2.0 | −1.8 |
| 500 | 10 | 0.5 | 0.5 | 0.5 | $TiO_2$<br>BaO<br>$B_2O_3$ | 0.5<br>0.5<br>0.5 | 18 | 45 | 22 | −4.6 | −2.1 | −1.5 |
| 700 | 2 | 0.5 | 0.5 | 0.5 | $TiO_2$<br>BaO<br>$B_2O_3$ | 0.5<br>0.5<br>0.5 | 9 | 50 | 26 | −2.4 | −0.8 | −0.7 |
| 800 | 2 | 0.5 | 0.5 | 0.5 | $TiO_2$<br>BaO<br>$B_2O_3$ | 0.5<br>0.5<br>0.5 | 10 | 49 | 27 | −2.5 | −0.7 | −0.8 |
| 1000 | 1 | 0.5 | 0.5 | 0.5 | $TiO_2$<br>BaO<br>$B_2O_3$ | 0.5<br>0.5<br>0.5 | 20 | 40 | 21 | −4.1 | −2.2 | −1.6 |
| 500 | 10 | 0.5 | 0.5 | 0.5 | $TiO_2$<br>BaO<br>NiO | 0.5<br>0.5<br>0.5 | 45 | 40 | 23 | −4.3 | −2.5 | −1.8 |
| 700 | 2 | 0.5 | 0.5 | 0.5 | $TiO_2$<br>BaO<br>NiO | 0.5<br>0.5<br>0.5 | 20 | 45 | 26 | −2.8 | −1.2 | −0.9 |
| 800 | 2 | 0.5 | 0.5 | 0.5 | $TiO_2$<br>BaO<br>NiO | 1.0<br>0.5<br>0.5 | 23 | 46 | 27 | −2.4 | −1.1 | −1.0 |
| 1000 | 1 | 0.5 | 0.5 | 0.5 | $TiO_2$<br>BaO<br>NiO | 1.0<br>0.5<br>0.5 | 50 | 41 | 24 | −4.1 | −2.4 | −1.9 |
| 500 | 10 | 0.5 | 0.5 | 0.5 | BaO<br>$B_2O_3$<br>NiO | 0.5<br>0.5<br>0.5 | 42 | 40 | 23 | −4.3 | −3.2 | −2.2 |
| 700 | 2 | 0.5 | 0.5 | 0.5 | BaO<br>$B_2O_3$<br>NiO | 0.5<br>0.5<br>0.5 | 25 | 46 | 27 | −2.5 | −1.3 | −0.9 |
| 800 | 2 | 0.5 | 0.5 | 0.5 | BaO<br>$B_2O_3$<br>NiO | 0.5<br>0.5<br>0.5 | 23 | 45 | 28 | −2.4 | −1.5 | −1.0 |
| 1000 | 1 | 0.5 | 0.5 | 0.5 | BaO<br>$B_2O_3$<br>NiO | 0.5<br>0.5<br>0.5 | 40 | 41 | 24 | −4.5 | −3.0 | −2.0 |
| 500 | 10 | 0.5 | 0.5 | 0.5 | $B_2O_3$<br>NiO<br>$Cr_2O_3$ | 0.5<br>0.5<br>0.5 | 32 | 40 | 22 | −4.5 | −3.9 | −2.0 |
| 700 | 2 | 0.5 | 0.5 | 0.5 | $B_2O_3$<br>NiO<br>$Cr_2O_3$ | 0.5<br>0.5<br>0.5 | 10 | 44 | 27 | −2.2 | −1.8 | −1.1 |
| 800 | 2 | 0.5 | 0.5 | 0.5 | $B_2O_3$<br>NiO<br>$Cr_2O_3$ | 0.5<br>0.5<br>0.5 | 15 | 45 | 26 | −2.4 | −1.5 | −0.9 |
| 1000 | 1 | 0.5 | 0.5 | 0.5 | $B_2O_3$<br>NiO<br>$Cr_2O_3$ | 0.5<br>0.5<br>0.5 | 28 | 40 | 21 | −4.6 | −3.8 | −2.3 |
| 500 | 10 | 0.5 | 0.5 | 0.5 | $TiO_2$<br>NiO<br>$Cr_2O_3$ | 0.5<br>0.5<br>0.5 | 35 | 36 | 20 | −3.4 | −3.2 | −2.6 |

Table 5-continued

| Heat-treating of zinc oxide powder | | Additives (mole %) | | | | | Electrical characteristics of Resultant resistor | | | Change Rate after Impulse Test (%) | | |
|---|---|---|---|---|---|---|---|---|---|---|---|---|
| Temp. (°C) | Time (hrs.) | $Bi_2O_3$ | CoO | MnO | other additives | | C(at a given Current of 1mA) (V) | $n_1$ | $n_2$ | ΔC(at a given current of 1mA) | $\Delta n_1$ | $\Delta n_2$ |
| 700 | 2 | 0.5 | 0.5 | 0.5 | $TiO_2$<br>NiO<br>$Cr_2O_3$ | 0.5<br>0.5<br>0.5 | 22 | 42 | 26 | −0.8 | −1.2 | −0.3 |
| 800 | 2 | 0.5 | 0.5 | 0.5 | $TiO_2$<br>NiO<br>$Cr_2O_3$ | 0.5<br>0.5<br>0.5 | 21 | 41 | 25 | −0.8 | −1.1 | −0.2 |
| 1000 | 1 | 0.5 | 0.5 | 0.5 | $TiO_2$<br>NiO<br>$Cr_2O_3$ | 0.5<br>0.5 | 40 | 37 | 21 | −3.3 | −3.5 | −2.5 |
| 500 | 10 | 0.5 | 0.5 | 0.5 | BaO<br>NiO<br>$Cr_2O_3$ | 0.5<br>0.5<br>0.5 | 45 | 38 | 20 | −4.8 | −3.3 | −2.7 |
| 700 | 2 | 0.5 | 0.5 | 0.5 | BaO<br>NiO<br>$Cr_2O_3$ | 0.5<br>0.5<br>0.5 | 22 | 42 | 25 | −1.5 | −0.9 | −0.4 |
| 800 | 2 | 0.5 | 0.5 | 0.5 | BaO<br>NiO<br>$Cr_2O_3$ | 0.5<br>0.5<br>0.5 | 21 | 42 | 25 | −1.7 | −0.8 | −0.8 |
| 1000 | 1 | 0.5 | 0.5 | 0.5 | BaO<br>NiO<br>$Cr_2O_3$ | 0.5<br>0.5<br>0.5 | 38 | 37 | 21 | −4.6 | −2.9 | −2.5 |
| 500 | 10 | 0.5 | 0.5 | 0.5 | $TiO_2$<br>NiO<br>$B_2O_3$ | 0.5<br>0.5<br>0.5 | 30 | 40 | 20 | −4.1 | −3.3 | −2.5 |
| 700 | 2 | 0.5 | 0.5 | 0.5 | $TiO_2$<br>NiO<br>$B_2O_3$ | 0.5<br>0.5<br>0.5 | 15 | 46 | 25 | −1.0 | −0.5 | −1.5 |
| 800 | 2 | 0.5 | 0.5 | 0.5 | $TiO_2$<br>NiO<br>$B_2O_3$ | 0.5<br>0.5<br>0.5 | 12 | 47 | 25 | −1.2 | −0.7 | −1.2 |
| 1000 | 1 | 0.5 | 0.5 | 0.5 | $TiO_2$<br>NiO<br>$B_2O_3$ | 0.5<br>0.5<br>0.5 | 28 | 41 | 21 | −4.0 | −3.2 | −2.8 |
| 500 | 10 | 0.5 | 0.5 | 0.5 | $TiO_2$<br>$B_2O_3$<br>$Cr_2O_3$ | 0.5<br>0.5<br>0.5 | 48 | 40 | 21 | −5.0 | −2.1 | −3.5 |
| 700 | 2 | 0.5 | 0.5 | 0.5 | $TiO_2$<br>$B_2O_3$<br>$Cr_2O_3$ | 1.0<br>0.5<br>0.5 | 38 | 48 | 27 | −2.5 | −0.3 | −1.1 |
| 800 | 2 | 0.5 | 0.5 | 0.5 | TiO<br>$B_2O_3$<br>$Cr_2O_3$ | 1.0<br>0.5<br>0.5 | 37 | 49 | 28 | −2.1 | −0.3 | −1.0 |
| 1000 | 1 | 0.5 | 0.5 | 0.5 | $TiO_2$<br>$B_2O_3$<br>$Cr_2O_3$ | 1.0<br>0.5<br>0.5 | 50 | 41 | 22 | −4.8 | −2.1 | −3.7 |
| 500 | 10 | 0.5 | 0.5 | 0.5 | BaO<br>NiO<br>$Cr_2O_3$ | 0.5<br>0.5<br>0.5 | 58 | 40 | 27 | −4.5 | −1.5 | −1.8 |
| 700 | 2 | 0.5 | 0.5 | 0.5 | BaO<br>NiO<br>$Cr_2O_3$ | 0.5<br>0.5<br>0.5 | 40 | 44 | 31 | −2.1 | −0.6 | −0.7 |
| 800 | 2 | 0.5 | 0.5 | 0.5 | BaO<br>NiO<br>$Cr_2O_3$ | 0.5<br>0.5<br>0.5 | 42 | 45 | 30 | −2.2 | −0.5 | −0.8 |
| 1000 | 1 | 0.5 | 0.5 | 0.5 | BaO<br>NiO<br>$Cr_2O_3$ | 0.5<br>0.5<br>0.5 | 65 | 40 | 26 | −4.8 | −1.2 | −1.5 |
| 500 | 10 | 0.5 | 0.5 | 0.5 | $TiO_2$<br>BaO<br>NiO<br>$Cr_2O_3$ | 0.5<br>0.5<br>0.5<br>0.5 | 50 | 41 | 30 | −2.5 | +0.1 | +0.1 |
| 700 | 2 | 0.5 | 0.5 | 0.5 | TiO<br>BaO<br>NiO<br>$Cr_2O_3$ | 0.5<br>0.5<br>0.5<br>0.5 | 38 | 45 | 32 | −1.9 | +1.8 | +2.0 |
| 800 | 2 | 0.5 | 0.5 | 0.5 | $TiO_2$<br>BaO<br>NiO<br>$Cr_2O_3$ | 0.5<br>0.5<br>0.5<br>0.5 | 35 | 45 | 32 | −1.8 | +1.9 | +2.0 |
| 1000 | 1 | 0.5 | 0.5 | 0.5 | $TiO_2$<br>BaO<br>NiO<br>$Cr_2O_3$ | 0.5<br>0.5<br>0.5<br>0.5 | 48 | 40 | 30 | −2.4 | +0.2 | +0.5 |
| 500 | 10 | 0.5 | 0.5 | 0.5 | $TiO_2$<br>NiO<br>$Cr_2O_3$<br>$B_2O_3$ | 0.5<br>0.5<br>0.5<br>0.5 | 50 | 43 | 30 | −1.3 | +0.5 | +0.2 |
| 700 | 2 | 0.5 | 0.5 | 0.5 | NiO<br>$Cr_2O_3$<br>$B_2O_3$ | 0.5<br>0.5<br>0.5 | 21 | 46 | 31 | −0.2 | +1.1 | +1.3 |
| 800 | 2 | 0.5 | 0.5 | 0.5 | $TiO_2$<br>NiO<br>$Cr_2O_3$<br>$B_2O_3$ | 0.5<br>0.5<br>0.5<br>0.5 | 25 | 46 | 31 | −0.1 | +1.2 | +1.5 |

Table 5-continued

| Heat-treating of zinc oxide powder | | Additives (mole %) | | | | Electrical characteristics of Resultant resistor | | | Change Rate after Impulse Test (%) | | |
|---|---|---|---|---|---|---|---|---|---|---|---|
| Temp. (°C) | Time (hrs.) | $Bi_2O_3$ | CoO | MnO | other additives | C(at a given Current of 1mA) (V) | $n_1$ | $n_2$ | ΔC(at a given current of 1mA) | $\Delta n_1$ | $\Delta n_2$ |
| 1000 | 1 | 0.5 | 0.5 | 0.5 | $TiO_2$ 0.5<br>NiO 0.5<br>$Cr_2O_3$ 0.5<br>$B_2O_3$ 0.5 | 48 | 42 | 30 | −1.8 | +0.3 | +0.1 |
| 500 | 10 | 0.5 | 0.5 | 0.5 | $TiO_2$ 0.5<br>BaO 0.5<br>NiO 0.5<br>$B_2O_3$ 0.5 | 25 | 35 | 30 | −2.0 | +0.2 | +0.1 |
| 700 | 2 | 0.5 | 0.5 | 0.5 | $TiO_2$ 0.5<br>BaO 0.5<br>NiO 0.5<br>$B_2O_3$ 0.5 | 13 | 38 | 31 | −1.4 | +1.2 | +1.1 |
| 800 | 2 | 0.5 | 0.5 | 0.5 | $TiO_2$ 0.5<br>BaO 0.5<br>NiO 0.5<br>$B_2O_3$ 0.5 | 15 | 40 | 30 | −1.1 | +1.5 | +1.3 |
| 1000 | 1 | 0.5 | 0.5 | 0.5 | $TiO_2$ 0.5<br>BaO 0.5<br>NiO 0.5<br>$B_2O_3$ 0.5 | 28 | 35 | 30 | −1.8 | +0.5 | +0.1 |
| 500 | 10 | 0.5 | 0.5 | 0.5 | $TiO_2$ 0.5<br>BaO 0.5<br>$Cr_2O_3$ 0.5<br>$B_2O_3$ 0.5 | 25 | 44 | 30 | −1.8 | +0.8 | +0.3 |
| 700 | 2 | 0.5 | 0.5 | 0.5 | $TiO_2$<br>BaO 0.5<br>$Cr_2O_3$ 0.5<br>$B_2O_3$ 0.5 | 13 | 47 | 32 | −1.1 | +2.8 | + 1.3 |
| 800 | 2 | 0.5 | 0.5 | 0.5 | $TiO_2$ 0.5<br>BaO 0.5<br>$Cr_2O_3$ 0.5<br>$B_2O_3$ 0.5 | 15 | 47 | 31 | −1.2 | +2.8 | +1.2 |
| 1000 | 1 | 0.5 | 0.5 | 0.5 | $TiO_2$ 0.5<br>BaO 0.5<br>$Cr_2O_3$ 0.5<br>$B_2O_3$ 0.5 | 30 | 45 | 30 | −1.7 | +0.2 | +0.4 |
| 500 | 10 | 0.5 | 0.5 | 0.5 | BaO 0.5<br>NiO 0.5<br>$Cr_2O_3$ 0.5<br>$B_2O_3$ 0.5 | 20 | 40 | 30 | −1.5 | +1.5 | +0.2 |
| 700 | 2 | 0.5 | 0.5 | 0.5 | BaO 0.5<br>NiO 0.5<br>$Cr_2O_3$ 0.5<br>$B_2O_3$ 0.5 | 15 | 42 | 31 | −1.0 | +3.0 | +1.5 |
| 800 | 2 | 0.5 | 0.5 | 0.5 | BaO 0.5<br>NiO 0.5<br>$Cr_2O_3$) 0.5<br>$B_2O_3$ 0.5 | 13 | 43 | 30 | −1.1 | +3.3 | +1.4 |
| 1000 | 1 | 0.5 | 0.5 | 0.5 | BaO 0.5<br>NiO 0.5<br>$Cr_2O_3$ 0.5<br>$B_2O_3$ 0.5 | 21 | 40 | 30 | −1.8 | +0.5 | +0.3 |
| 500 | 10 | 0.5 | 0.5 | 0.5 | $TiO_2$ 0.5<br>BaO 0.5<br>NiO 0.5<br>$Cr_2O_3$ 0.5<br>$B_2O_3$ 0.5 | 28 | 50 | 30 | −0.8 | +2.0 | +1.2 |
| 700 | 2 | 0.5 | 0.5 | 0.5 | $TiO_2$ 0.5<br>BaO 0.5<br>NiO 0.5<br>$Cr_2O_3$ 0.5<br>$B_2O_3$ 0.5 | 12 | 50 | 30 | −0.5 | +5.0 | +5.2 |
| 800 | 2 | 0.5 | 0.5 | 0.5 | $TiO_2$ 0.5<br>BaO 0.5<br>NiO 0.5<br>$Cr_{2\ 03}$ 0.5<br>$B_2O_3$ 0.5 | 15 | 50 | 30 | −0.5 | +5.0 | +5.2 |
| 1000 | 1 | 0.5 | 0.5 | 0.5 | $TiO_2$ 0.5<br>BaO 0.5<br>NiO 0.5<br>$Cr_2O_3$ 0.5<br>$B_2O_3$ 0.5 | 20 | 50 | 30 | −0.5 | +2.0 | +1.0 |

EXAMPLE 6

The resistors of Examples 2, 3, 4 and 5 were tested in accordance with a method widely used in testing electronic component parts. A heating cycle test was carried out by repeating 5 times the cycle in which the resistors are kept at 85°C ambient temperature for 30 minutes, cooled rapidly to −20°C and then kept at such temperature for 30 minutes. A humidity test was carried out at 40°C and 95% relative humidity for 1000 hrs. Table 8 shows the average change rates of the C-value and n-value of the resistors after the heating cycle test and the humidity test. It is easily understood that each sample has a small change rate.

Table 6

| Sample No. | Heating cycle Test (%) | | | Humidity Test (%) | | |
|---|---|---|---|---|---|---|
| | ΔC | $\Delta n_1$ | $\Delta n_2$ | ΔC | $\Delta n_1$ | $\Delta n_2$ |
| Example 2 | −4.5 | −6.5 | −6.2 | −5.3 | −6.6 | −6.1 |
| Example 3 | −3.5 | −4.3 | −4.4 | −3.2 | −4.1 | −4.4 |
| Example 4 | −0.3 | −0.2 | −0.3 | −1.3 | −1.5 | −1.6 |
| Example 5 | −0.4 | −0.5 | −0.7 | −1.8 | −1.7 | −2.0 |

What is claimed is:

1. In a process for making a bulk-type voltage-dependent resistor in which zinc oxide (ZnO) powder and additives are admixed to form a sintered body composition having as the main constituent, zinc oxide, and in which the mixture is formed into a resistor body, the body is sintered, and electrodes are applied to the opposite surfaces of the sintered body, the improvement comprising the step of, prior to sintering and admixture with said additives, heat-treating the zinc oxide powder at a temperature of from 500° to 1000°C.

2. The improvement according to claim 1, in which said temperature for heat-treating the zinc oxide powder is from 700° to 800°C.

3. The improvement according to claim 1 further comprising, in the step of mixing the sintered body composition, mixing together as a main constituent, 99.98 to 80 mole percent of zinc oxide (ZnO), and, as additives 0.01 to 10 mole percent of bismuth oxide ($Bi_2O_3$), and 0.01 to 10 mole percent, in total, of two members selected from the group consisting of cobalt oxide (CoO), uranium oxide ($UO_2$), manganese oxide (MnO), antimony oxide ($Sb_2O_3$), barium oxide (BaO), strontium oxide (SrO) and lead oxide (PbO).

4. The improvement according to claim 3, in which said temperature for heat-treating the zinc oxide powder is from 700°C to 800°C.

5. The improvement according to claim 1 which comprises mixing 0.01 to 10 mole percent of bismuth oxide ($Bi_2O_3$), 0.1 to 3.0 mole percent of cobalt oxide (CoO), 0.1 to 3.0 mole percent of manganese oxide (MnO), at least one member selected from the group consisting of 0.01 to 8.0 mole percent of antimony oxide ($Sb_2O_3$), 0.1 to 5.0 mole percent of tin oxide ($SnO_2$), and 0.01 to 10 mole percent of silicon oxide ($SiO_2$), and at least one member selected from the group consisting of 0.01 to 5.0 mole percent of chromium oxide ($Cr_2O_3$), 0.01 to 5.0 mole percent of nickel oxide (NiO) and as the remainder, zinc oxide (ZnO).

6. The improvement according to claim 5 in which said temperature for heat-treating the zinc oxide powder is from 700°C to 800°C.

7. The improvement according to claim 1, which comprises mixing 0.01 to 10.0 mole percent of bismuth oxide ($Bi_2O_3$), 0.1 to 3.0 mole percent of cobalt oxide (CoO), 0.1 to 3.0 mole percent of manganese oxide (MnO) and at least one member selelcted from the group consisting of 0.1 to 3.0 mole percent of titanium oxide ($TiO_2$), 0.01 to 5.0 mole percent of nickel oxide (NiO), 0.01 to 5.0 mole percent of chromium oxide ($Cr_2O_3$), 0.01 to 5.0 mole percent of barium oxide (BaO) and 0.01 to 5.0 mole percent of boron oxide ($B_2O_3$) and as the remainder, zinc oxide (ZnO).

8. The improvement according to claim 7 in which said temperature for heat-treating the zinc oxide powder is from 700°C to 800°C.

9. In a bulk type voltage-dependent resistor produced by admixing zinc oxide (ZnO) powder and additives to form a sintered body composition having as the main constituent the zinc oxide, and wherein the mixture is formed into a resistor body, the body is sintered, and electrodes are applied to opposite surfaces of the sintered body, the improvement in the process comprising the step of, prior to sintering and admixing with said additives, heat-treating the zinc oxide powder at a temperature of from 500° to 1000°C.

10. A voltage-dependent resistor according to claim 9 in which said temperature for heat-treating the zinc oxide powder is from 700° to 800°C.

11. A voltage-dependent resistor according to claim 9 in which the improved process further comprises, in the step of mixing the sintered body composition, mixing together as a main constituent, 99.98 to 80 mole percent of zinc oxide (ZnO), and, as additives, 0.01 to 10 mole percent of bismuth oxide ($Bi_2O_3$), and 0.01 to 10 mole percent, in total, of two members selected from the group consisting of cobalt oxide (CoO), uranium oxide ($UO_2$), manganese oxide (MnO), antimony oxide ($Sb_2O_3$), barium oxide (BaO), strontium oxide (SrO) and lead oxide (PbO).

12. A voltage-dependent resistor as claimed in claim 11 in which said temperature for heat-treating the zinc oxide powder is from 700° to 800°C.

13. A voltage-dependent resistor according to claim 9 in which the improved process further comprises in the step of mixing the sintered body composition, mixing together as a main constituent, zinc oxide (ZnO), and, as additives, 0.01 to 10 mole percent of bismuth oxide ($Bi_2O_3$), 0.1 to 3.0 mole percentage of cobalt oxide (CoO), 0.1 to 3.0 mole percent of manganese oxide (MnO), at least one member selected from the group consisting of 0.01 to 8.0 mole percent of antimony oxide ($Sb_2O_3$), 0.1 to 5.0 mole percent of tin oxide ($SnO_2$), and 0.01 to 10 mole percent of silicon oxide ($SiO_2$), and at least one member selected from the group consisting of 0.01 to 5.0 mole percent of chromium oxide ($Cr_2O_3$), 0.01 to 5.0 mole percent of nickel oxide (NiO).

14. A voltage-dependent resistor as claimed in claim 13 in which said temperature for heat-treating the zinc oxide powder is from 700° to 800°C.

15. A voltage dependent resistor according to claim 9 in which the improved process further comprises, in the step of mixing the sintered body composition, mixing 0.01 to 10.0 mole percent of bismuth oxide ($Bi_2O_3$), 0.1 to 3.0 mole percent of cobalt oxide (CoO), 0.1 to 3.0 mole percent of manganese oxide (MnO) and at least one member selected from the group consisting of 0.1 to 3.0 mole percent of the titanium oxide ($TiO_2$), 0.01 to 5.0 mole percent of nickel oxide (NiO), 0.01 to 5.0 mole percent of chromium oxide ($Cr_2O_3$), 0.01 to 5.0 mole percent of barium oxide (BaO) and 0.1 to 5.0 mole percent of boron oxide ($B_2O_3$).

16. A voltage-dependent resistor as claimed in claim 15 in which said temperature for heat-treating the zinc oxide powder is from 700° to 800°C.

* * * * *